US007237881B2

(12) United States Patent
Hayasaki et al.

(10) Patent No.: US 7,237,881 B2
(45) Date of Patent: Jul. 3, 2007

(54) LIQUID CONTAINER, LIQUID SUPPLYING SYSTEM, MANUFACTURING METHOD THEREFOR, CIRCUIT BOARD THEREFOR AND LIQUID CONTAINING CARTRIDGE

(75) Inventors: Kimiyuki Hayasaki, Kanagawa (JP); Haruyuki Matsumoto, Kanagawa (JP); Kenjiro Watanabe, Tokyo (JP); Nobuyuki Hatasa, Kanagawa (JP); Masanori Takenouchi, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 267 days.

(21) Appl. No.: 11/016,757

(22) Filed: Dec. 21, 2004

(65) Prior Publication Data

US 2005/0179750 A1 Aug. 18, 2005

(30) Foreign Application Priority Data

Dec. 26, 2003 (JP) ..... 2003-435942
Nov. 2, 2004 (JP) ..... 2004-319751

(51) Int. Cl.
*B41J 2/175* (2006.01)
*B41J 29/393* (2006.01)

(52) U.S. Cl. ..... 347/86; 347/19

(58) Field of Classification Search ..... 347/5, 347/19, 49, 50, 86; 399/64
See application file for complete search history.

(56) References Cited

U.S. PATENT DOCUMENTS 5,049,898 A * 9/1991 Arthur et al. ..... 347/19
5,365,312 A * 11/1994 Hillmann et al. ..... 399/12
5,400,066 A 3/1995 Matsumoto et al. ..... 347/86
5,583,549 A 12/1996 Ujita et al. ..... 347/86
5,699,091 A * 12/1997 Bullock et al. ..... 347/19
5,940,102 A 8/1999 Watanabe et al. ..... 347/86
6,062,667 A 5/2000 Matsui et al. ..... 347/19
6,196,670 B1 3/2001 Saruta ..... 347/86
6,246,484 B1 * 6/2001 Shimamura et al. ..... 358/1.12
6,312,074 B1 * 11/2001 Walker ..... 347/7
6,402,310 B1 6/2002 Maeda et al. ..... 347/87
6,422,675 B1 7/2002 Tomomatsu ..... 347/7
6,431,681 B2 8/2002 Hatasa et al. ..... 347/19
6,554,411 B1 4/2003 Hatasa et al. ..... 347/86
6,609,788 B2 8/2003 Hatasa et al. ..... 347/86
6,702,427 B2 3/2004 Shimizu et al. ..... 347/50

(Continued)

FOREIGN PATENT DOCUMENTS

EP 1247651 10/2002

(Continued)

*Primary Examiner*—Anh T. N. Vo
(74) *Attorney, Agent, or Firm*—Fitzpatrick, Cella, Harper & Scinto

(57) ABSTRACT

A liquid container detachably mountable to a recording apparatus to which a plurality of liquid containers are detachably mountable, wherein the recording apparatus includes apparatus electrical contacts corresponding to the liquid containers, respectively, photoreceptor means for receiving light, and an electric circuit connected with a line which is commonly connected with the apparatus electrical contacts, the liquid container includes a container electrical contact electrically connectable with one of the apparatus contacts; an information storing portion capable of storing at least individual information relating to the liquid container; a light emitting portion; an actuating portion for actuating the light emitting portion; a controller for controlling access to the information storing portion and/or actuation of the light emitting portion by the driver in response to individual information supplied from the recording device and reception of a command from the recording device.

24 Claims, 29 Drawing Sheets

U.S. PATENT DOCUMENTS

| | | | | |
|---|---|---|---|---|
| 6,742,857 | B2 | 6/2004 | Koshikawa et al. | 347/19 |
| 6,742,872 | B2 | 6/2004 | Fukazawa et al. | 347/50 |
| 6,808,256 | B2 | 10/2004 | Umeyama et al. | 347/87 |
| 6,815,381 | B1 | 11/2004 | Yamamoto et al. | 442/187 |
| 6,824,258 | B2 | 11/2004 | Yamamoto et al. | 347/86 |
| 6,869,158 | B2 | 3/2005 | Kojima et al. | 347/19 |
| 2002/0008722 | A1 | 1/2002 | Imanaka et al. | 347/14 |
| 2002/0008724 | A1 | 1/2002 | Kubota et al. | 347/19 |
| 2003/0215280 | A1 | 11/2003 | Hatasa et al. | 401/132 |
| 2003/0227501 | A1 | 12/2003 | Hatasa et al. | 347/19 |
| 2003/0234844 | A1 | 12/2003 | Yamamoto et al. | 347/86 |
| 2004/0100540 | A1 | 5/2004 | Hatasa et al. | 347/86 |
| 2005/0007420 | A1 | 1/2005 | Ogawa et al. | 347/50 |
| 2005/0036016 | A1 | 2/2005 | Watanabe et al. | 347/86 |

FOREIGN PATENT DOCUMENTS

| | | |
|---|---|---|
| JP | 4-275156 | 9/1992 |
| JP | 6-155769 | 6/1994 |
| JP | 7-076104 | 3/1995 |
| JP | 2000-326604 | 11/2000 |
| JP | 2002-005724 | 1/2002 |
| JP | 2002-005818 | 1/2002 |
| JP | 2002-301829 | 10/2002 |

* cited by examiner

LIQUID CONTAINER, LIQUID SUPPLYING SYSTEM, MANUFACTURING METHOD THEREFOR, CIRCUIT BOARD THEREFOR AND LIQUID CONTAINING CARTRIDGE

FIELD OF THE INVENTION AND RELATED ART

The present invention relates to a liquid container, a liquid supplying system using the container, a manufacturing method for the container, a circuit board for the container, and a liquid containing cartridge, more particularly to a liquid container and a liquid supplying system, more particularly, to a liquid container which is capable of notifying a state of the liquid container using light emitting means such as a LED, the state including an ink remaining amount of an ink container for ink jet recording, and to a liquid supplying system using such a container, to a manufacturing method for such a container, to a circuit board for such a container and to a liquid containing cartridge using such a container.

FIELD OF THE INVENTION AND RELATED ART

Conventionally, a recording device for recording desired, letters, images or the like on a recording material such as recording sheet of paper or the like to output information in personal computers, facsimile machines and so on. In such a recording device, there is a strong demand for high resolution, high speed and high precision recording is desired both in the fields of business use and personal use, and in addition, there is also a demand for cost reduction and reliability.

There are various types of recording systems, among which an ink jet recording apparatus which effects recording by ejecting ink from an ejection outlet to a recording material, can perform low noise non-impact recording, and has a structural feature which permits high speed and high resolution recording. In addition, an inexpensive color printer can be to accomplished. For this reasons, the ink jet recording apparatus is widely used. The ink jet recording apparatus comprises a recording head including an ejection outlet and an element for generated energy for ejecting ink through the ejection outlet (a electrothermal transducer element for generating thermal energy effective to create film boiling in the ink, for example), wherein ink is detected onto the recording material in accordance with the desired information to be recorded.

In an example of a structure of the ink jet recording head, a plurality of ejection outlets are arranged in a line or in lines, and energy generating elements are disposed inside the respective ejection outlets. In such an ink jet recording head, the recording head and the ink container which is a liquid container for containing the ink to be supplied to the recording head, are unified to form a unit. Different units are provided depending on the colors and/or kinds of the ink and are supported on a carriage. In another example, the ink jet recording head is a separate member from an ink container in the form of a cartridge (ink cartridge), wherein the ink jet recording head has a plurality of ejection portions correspondingly to the colors and kinds of the ink (for example, black (K), yellow (Y), magenta (M) and cyan (C) inks), and a plurality of cartridges are loaded. In the former structure, the cartridge integrally having the ink container and the recording head is detachably mountable to the main assembly of the recording device as a unit, and in the latter structure, only the ink cartridge is detachably mountable with the recording head held in the main assembly of the recording device.

In any other structures, the performance of the ink jet recording head has been remarkably improved to meet recent demand for high precision recording and high image quality recording. In other words, a larger number of ejection outlets and energy generating elements are provided in the recording head, and an increasing number of energy generating elements are simultaneously driven, by which the recording speed and therefore recording throughput are improved.

Japanese Laid-open Patent Application Hei 7-076104 discloses that in a recording head having such high performance, an ink jet recording head 1105 is provided with a storing element such as an EEPROM storing individual information of the recording head 1105 per se, to provide the service life and/or the time when the ink jet recording head 1105 is to be exchanged.

FIG. 27 illustrates the structure. In the structure of this Figure the electric signal wiring from the recording head 1105 having the EEPROM 1018 includes only those designated by 1016(*a*)-1016-1016(*c*) which are expanded from a connector 1028 on the recording head 1105 and are connected to CPU Central-Processing-Unit) 1300 into control circuit portion provided in the main assembly of the recording device through a flexible cable 1206.

The ink cartridge carries a storing element storing information such as ink remaining amount, and the information can be presented to the main assembly side of the recording device.

FIGS. 28 and 29 illustrate two examples. In the structure of FIG. 28, the plurality of ink cartridges 1001K, 1001Y, 1001M and 1001C have respective storing elements 1100A, 1100B, 1100C. The signal lines for the respective storing elements are gathered on the recording head 1105 together with the signal lines for the storing elements 1018, and the group of the signal line 1016 is connected to the CPU1300 in the control circuit portion of the main assembly of the recording device from the connector 1028 on the recording head 1105 through the flexible cable 1206. With the structure of FIG. 29, storing elements 1100A–1100D for storing various information are directly connected to the CPU1300 in the control circuit portion of the main assembly of the recording device not through the recording head 1105 to effect preferable operation control.

As will be understood from these examples, there are various types for the electrical connection between the main assembly of the recording device and the recording elements disposed in the ink cartridge or the recording head, corresponding to the structure of the recording device.

In order to accomplish the above-described high quality, the ink has been improved. More particularly, the components and composition ratios of the recently used inks are complicated and exquisite in consideration of various properties in order to accomplish high recording performance. In an example, in order to enhance the weather-resistant property of the ink and the robustness of the recorded image, some ink contain a pigment component in addition to dye components; in order to meet the demand for high speed printing, a resin material component is added to enhance the fixing; and the composition is determined in consideration of the chemical reaction between different color inks (in the case of multi-color recording). In addition, the kind of the ink may be changed depending on the materials of the recording material (paper designed particularly for ink jet recording, plain paper, resin material sheet, textile or the like) and/or depending on the desired visual effect (glossiness, use of gold color and/or silver color).

Further improvement of the recording quality is accomplished by using such ink having the component and the composition ratio different form those of conventional inks. Such ink works properly when only same kinds of inks are used, thus permitting high quality recording. However, in the case that different kinds of ink are alternately used in one recording device, and a plurality of ink cartridges are mountable to one ink jet recording head having a plurality of ejection portions, the different kinds of inks are mixed inside one ejection portion with the result of reaction between the different kinds of inks and agglomeration or solidification. If this occurs, the recording operation is damaged by deposition on the ink supply passage in the ejection portion, the liquid passage in the ejection outlet or the side having the ejection outlets. Therefore, considerations have to be paid to avoid mixture of the different kind inks in the recording device. Therefore, it is strongly desired that mounting of an ink cartridge to a wrong position (different color position) is prevented.

The first method to do this is to different configurations of the ink cartridges are used for different inks, thus preventing the ink cartridges from being mounted to wrong positions. However, in such a case, the manufacturing cost of the ink cartridges is very high, and storage and management of ink cartridges having different configurations are cumbersome.

The second method is shown in FIGS. 28 and 29, wherein ink cartridges 1001K–1001C have storing elements 1100A–1000D for storing data indicative of the kinds of the ink-contained therein, respectively. For example, Japanese Laid-open Patent Application Hei 6-155769 discloses that storing element of the ink cartridge is connected to the electric circuit of the main assembly of the recording device to permit the kinds of the ink to be recognized by difference in the voltage. U.S. Pat. No. 6,196,670 discloses a control IC in the main assembly of the recording device is connected to the storing elements storing the data indicative of the kind of the ink contained therein, date and time of manufacture thereof, so that data is read and written. If an ink cartridge is mounted to a wrong position, the event is recognized on the basis of information in the ink cartridge, and is notified to the user, thus the inconveniences can be avoided beforehand.

In addition, when the information such as the kind of the contained ink, remaining amount thereof, service life or the like is stored in the ink cartridge 1K–1C per se as disclosed in Japanese Laid-open Patent Application Hei 6-155769 and U.S. Pat. No. 6,196,670, and the recording head 1105 is provided with storing elements 1018 to store a discrimination number of the recording head 1105, a number of total prints or the like, then the ink cartridges 1001A–1001D and the kind of the ink in the ink cartridge 1001A–1001D can be recognized by the CPU 1300 of the main assembly of the recording device reading the information in the storing elements 1018 and 1100A–1100D, and in addition, the service gives of the recording head 1105 and the ink cartridge 1001A–1001D and timing of exchange thereof can be appropriately determined. Additionally, by setting a condition of a refreshing process for maintaining the optimum recording condition the ink ejection performance of the recording head in accordance with the kinds of the ink, satisfy recording can be executed.

Furthermore, Japanese Laid-open Patent Application Hei 4-275156 discloses another example of the structures for appropriately notifying the service life of the recording head 105 or ink cartridges 1001A–1001D and the timing of exchange thereof. With this structure, a cartridge integrally having t recording head and ink container is provided with a light emitting portion in the form of LED, and the ink remaining amount can be notified in accordance with the information of the storing element storing the number of recording electric power supplies for the cartridge.

However, when the ink cartridge carries the storing element for storing the various information including the kind of the ink in addition to the storing element 1018 carried on the storing element 1018, all of the storing elements have to be electrically connected to the CPU1300 of the control circuit portion in the main assembly of the recording device to permit communication of information therebetween. Therefore, with the increase of the number of the storing elements, the number of the signal lines 1016 increases for connecting them.

Particularly, in view of the recent trend that inexpensive recording device is operable with wide variety of inks, the connecting portions for connection between the storing elements provided in both of the recording head and a plurality of ink cartridges and the CPU1300 of the control circuit portion in the main assembly of the recording device, have to be permanently provided. In an ordinary color recording, four color inks (black, yellow, magenta and cyan) are used, and therefore, four ink cartridges 1001K, 1001Y, 1001M and 1001C are simultaneously mounted on the main assembly of the recording device. Therefore, the signal line 1016 is necessary for each of the four storing element 1100A-s 1000D of the ink cartridges 1001K, 1001Y, 1001M and 1001C, wherein two or more signal lines 1016 are provided for each of the storing elements. In the case that recording head 1105 is provided with a storing element 1018, three, for example, signal lines 1016 are required in addition to the lines for the storing elements of the ink cartridge. As a result, even in the case that all the signal lines are connected to the CPU1300 through the recording head 1105, as shown in FIG. 28, and even in the case that storing element 18 of the recording head 1105 and the storing elements 1100A–1100D of the ink cartridges 1001K, 1001Y and 1001M and 1001C are direct Lines connected to the CPU1300, the number, not less than twice the total number of the storing elements, of signal lines 1016 are required.

When the number of the signal lines 1016 largely increases, the connection step becomes cumbersome since the reliability of the electrical connections have to be maintained. Particularly, in the case of a popular type recording device, the mounting and demounting are carried out by the user, the complication of the connection step is not desirable. Furthermore, the main assembly of the recording device has to have a large number of contacts and/or wiring leads for connection with the signal lines 1016 with the result of manufacturing cost rise and complication of structure.

Then the ink cartridge is provided with notifying means to notify the ink remaining amount, as disclosed in Japanese Laid-open Patent Application Hei 4-275156, additional wiring lead is necessary for ON/OFF of the notifying means. At least one such wiring lead is required per one ink cartridge without consideration to the ground line. Namely, in the case that four or more ink cartridges are used for color recording, more than four signal lines are required with the result that number of connections with the main assembly of the recording device is even larger.

SUMMARY OF THE INVENTION

Accordingly, it is a principal object of the present invention to provide a liquid container, a liquid supplying system, a manufacturing method for liquid container, a circuit board therefor and a liquid containing cartridge, with which the cartridge is provided with a storing element and a light emitting portion, and the information stored in the storing element is transmitted to a main assembly of the recording device, so that process may be carried out corresponding to the state of each of t cartridges (an ink remaining amount of each of the cartridges, for example); and the problem of the such that can be notified; wherein the number of signal lines for connection with the main assembly side of the recording device can be reduced even when a plurality of cartridges are used.

It is another object of the present invention to provide a liquid container, a liquid supplying system, a manufacturing method for liquid container, a circuit board therefor and a liquid containing cartridge which are less expensive without the necessity of complication of connection steps of the electrical connections.

According to an aspect of the present invention, there is provided a liquid container detachably mountable to a recording apparatus to which a plurality of liquid containers are detachably mountable, wherein said recording apparatus includes apparatus electrical contacts corresponding to the liquid containers, respectively, photoreceptor means for receiving light, and an electric circuit connected with a line which is commonly connected with said apparatus electrical contacts, said liquid container comprising a container electrical contact electrically connectable with one of said apparatus contacts; an information storing portion capable of storing at least individual information relating to said liquid container; a light emitting portion; an actuating portion for actuating said light emitting portion; a controller for controlling access to said information storing portion and/or actuation of said light emitting portion by said driver in response to individual information supplied from the recording device and reception of a command from the recording device.

According to another aspect of the present invention, there is provided a liquid container detachably mountable to a recording apparatus to which a plurality of liquid containers are detachably mountable at different positions, wherein said recording apparatus includes apparatus electrical contacts corresponding to the liquid containers, respectively, photoreceptor means for receiving light, and an electric circuit connected with a line which is commonly connected with said apparatus electrical contacts, said liquid container comprising a container electrical contact electrically connectable with one of said apparatus contacts; an information storing portion storing at least individual information relating to said liquid container; a light emitting portion for emitting light to said position detecting means; an actuating portion for actuating said light emitting portion; a controller for controlling access to said information storing portion and/or actuation of said light emitting portion by said driver in response to individual information supplied from the recording device and reception of a command from the recording device.

According to the present invention, by providing the storing element and the light emitting portion on the cartridge and by transmission of the information stored in the storing element to the main assembly of the recording device, a process can be carried out depending on the state of the cartridge (ink remaining amount, for example). The state of the cartridge can be notified by the light emitting portion. In addition, the increase of the number of the signal lines for connection with the main assembly side of the recording device can be suppressed even when a plurality of cartridges are used. Furthermore, modification for an increased number of the cartridges is easy. Moreover, the reliability of the electrical connections can be maintained without cumbersome of the connection step, and the recording device or the like can be made inexpensive.

These and other objects, features and advantages of the present invention will become more apparent upon a consideration of the following description of the preferred embodiments of the present invention taken in conjunction with the accompanying drawings.

BRIEF DESCRIPTION OF THE DRAWINGS

FIG. 1 is a side view (a), front view (b) and bottom view (c) of an ink container which the present invention is applicable to.

FIG. 2 is a sectional side elevation of an ink container which the present invention is applicable to.

FIG. 3 is schematic side views ((a) and (b)) of a substrate provided on the ink container which the present invention is applicable to.

FIG. 5 is a side view (a) and front view (b) of an example of controller substrate mounted to an ink container which the present invention is applicable to.

FIG. 6 is a perspective view showing an example of a recording head unit having a holder for receiving an ink container which the present invention is applicable to.

FIG. 8 is a perspective view showing another example of a structure of an ink container mounting portion which the present invention is applicable to.

FIG. 13 is a circuit diagram showing the details of the substrate provided with controllers and so on.

DESCRIPTION OF THE PREFERRED EMBODIMENTS

The description will be made as to the embodiments of the present invention in conjunction with the accompanying drawings, in the following order:

1. Example of Mechanical Structure Which Present Invention is Applicable to.
   1.1 Ink Container.
   1.3 Ink Container Mounting Portion.
   1.4 Recording Device:

2. Example of Structure of Control System Which Present Invention is Applicable to.
   2.1 General Arrangement.
   2.2 Connecting Portion:
   2.3 Structure of Controller.
   2.4 Operation of Controller.
   2.3 Control Process:

3. Other Embodiments:

1. Example of Mechanical Structure Which Present Invention is Applicable to.

The description will first be made as to an example of a mechanical structure of a cartridge which the present invention is applicable to, and an ink jet recording apparatus usable therewith.

1.1 Ink Container (FIG. 1–FIG. 5).

Figure 1:
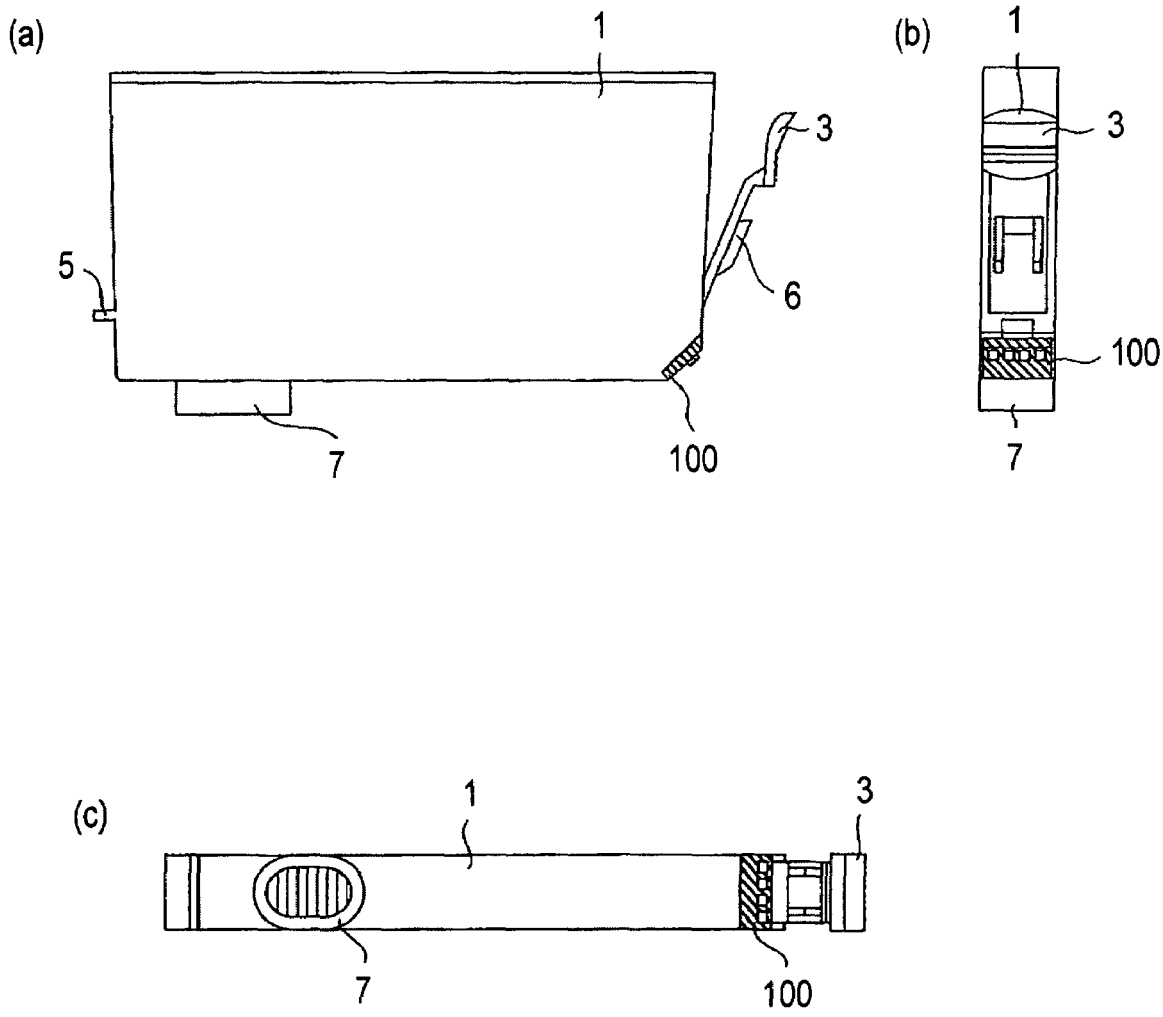
Figure 2:
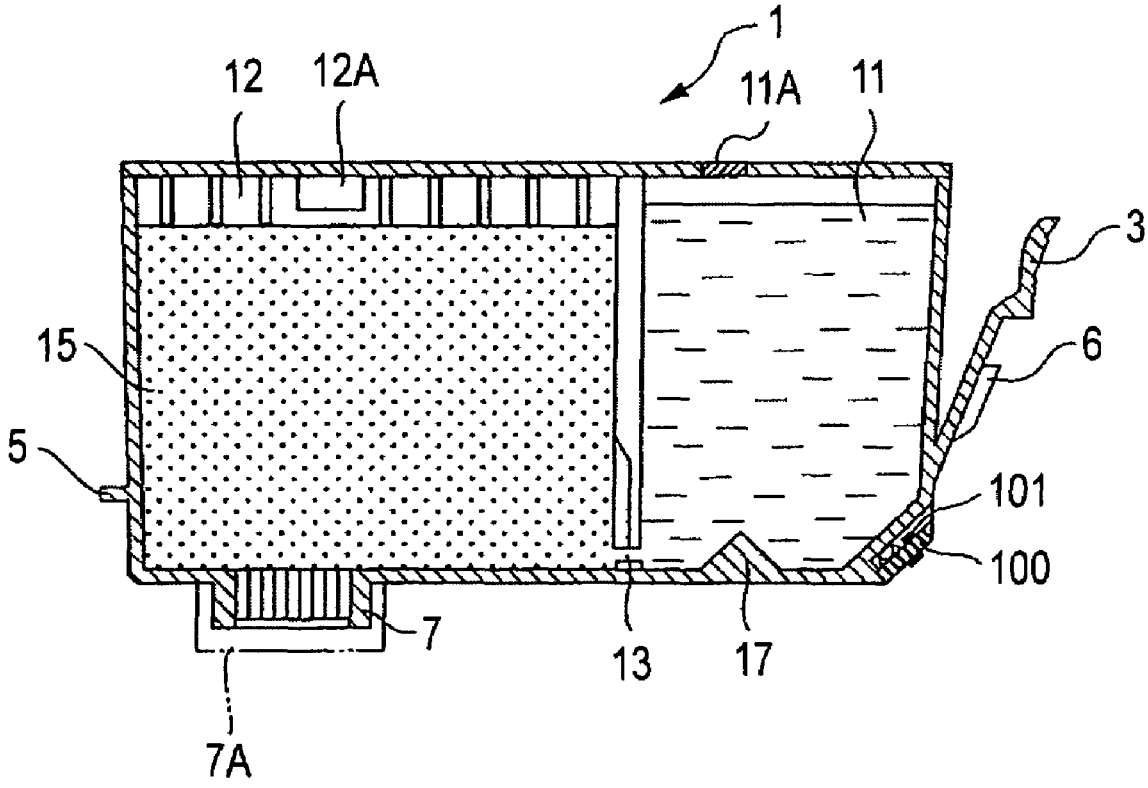

FIG. 1 is a side view (a), front view (b) and bottom view (c) of an ink container which the present invention is applicable to, and FIG. 2 is a sectional side elevation of the ink container which the present invention is applicable to. In the following descriptions, the front side of the ink container is the side which is faced to the user who is manipulating the ink container (mounting and demounting operation of the ink container), which provides the user with information (by light emission of LED which will be described hereinafter).

In FIG. 1, the ink container 1 of this embodiment has a supporting member 3 supported on the lower portion at the front side side thereof. The supporting member 3 is made of resin material integrally molded with an outer casing of the ink container 1, and the ink container 1 is displaceable about a portion of the ink container to be supported when the ink container 1 is mounted to the container holder. The ink container 1 is provided on its rear side and front side with a first engaging portion 5 and second engaging portion 6, respectively, which are engageable with locking portions provided in a container holder. In this embodiment, they are integral with the supporting member 3. By engagement of the engaging portion 5 and the engaging portion 6 with the locking portions, the ink container 1 is securedly mounted in the ink container 1. The operation during the mounting will be described hereinafter referring to FIG. 15.

The bottom surface of the ink container 1 is provided with an ink supply port 7 for ink supply, which port is connectable with an ink introduction opening of the recording head which will be described hereinafter, by mounting of the ink container 1 to the container holder. A base member is provided on the bottom side of the supporting portion of the supporting member 3 at a position where the bottom side and the front side intersect with each other. The base member may be in the form of a chip or a plate. In the following description, it is called "substrate" 100.

FIG. 2 FIG. 2 is a sectional side elevation of the ink container 1. An inside of the ink container 1 is divided into an ink reservoir chamber 11 which is provided adjacent the front side where the supporting member 3 and the substrate 100 are provided, and a negative pressure generating member accommodating chamber 12 which is provided adjacent the rear side and which is in fluid communication with an ink supply port 7. The ink reservoir chamber 11 and the negative pressure generating member accommodating chamber 12 are in fluid-communication with each other through a communication port 13. The ink reservoir chamber 11 contains the ink alone in this embodiment, whereas the negative pressure generating member accommodating chamber 12 accommodates an ink absorbing material 15 (negative pressure generating member which is a porous member in this embodiment) made of sponge, fiber aggregate or the like for retaining the ink by impregnation. The porous member 15 functions to generate such a negative pressure as is sufficient to provide balance with the force of meniscus formed in the ink ejection nozzle of the recording head to prevent ink leakage from the ink ejection portion to the outside and to permits ink ejection by actuation of the recording head.

In the top surface of the negative pressure generating member accommodating chamber 12, an air vent 12A for introduction of the ambience to ease the negative pressure tending to increase with ink supply into the recording head and to maintain the negative pressure within a predetermined preferable range.

The ink container 1 shown in FIG. 2 may be manufactured by preparing a container body of the ink container 1 on which a substrate which will be described hereinafter is mounted, and then injecting the ink thereinto. The ink injection port for carried out such a method may be formed in a top surface of the ink reservoir chamber 11, for example. Then, the injection port may be sealed by a sealing member 11A after t ink injection.

In a possible alternative, at a certain point after the ink is consumed following the start of the use of the ink container 1, that is, when the ink remaining amount in the container becomes substantially zero, for example, the sealing member 11A may be dismounted or may be broken to reform an injection port, and the ink is injected using an injector, and then, the reformed injection port may be re-sealed by a sealing member 11A or a substitute member, if necessary. In place of using the original injection port, opening may be formed at another position in the top surface of the ink reservoir chamber 11, for example, and the ink may be injected through the opening, and then, the opening may be sealed. For example, the Embodiments of the manufacturing method for the ink container are in tended to cover such manufacturing methods in which the ink is injected into the ink container containing some responsibility zero amount of the ink.

The sealing member 7A is detachably mountable in order to prevent of the ink leakage during transportation or storage of the manufactured ink container 1. The sealing member 7A may be of any type, such as a capping or typing member or the like, if a predetermined sealing property is provided, and it is removable when the ink container is mounted to the recording head. In the case that ink container is dismounted from the recording head after the start of use, the sealing member 7A and the substitute member may be used to seal the ink supply port 7.

The internal structure of the ink container 1 is not limited to such a partitioned structure in which the inside is partitioned into the porous member accommodating chamber and the reservoir containing the ink alone. In another example, the porous member may occupy substantially all of the inside space of the ink container. The negative pressure generating means is not limited to the one using the porous member. In another example, the ink alone is contained in a bladder-like member made of elastic material such as rubber or the like which produces tension in the direction of expanding the volume thereof. In such a case, the negative pressure is generated by the tension in the bladder-like member to retain the ink. In a further example, at least a part of the ink accommodation space is constructed by a flexible member, and the ink alone is accommodated in the space, wherein a spring force is applied to the flexible member, by which a negative pressure is generated. In such cases, the ink container may be manufactured by injecting the ink in the above-described manner. In such cases, the ink injection may be carried out utilizing the air vent portion, which is provided to introduce the ambience in order to ease the negative pressure tending to increase with ink supply into the recording head and in order to maintain the negative pressure within a predetermined preferable range, as described hereinbefore.

The bottom portion of the ink reservoir chamber 11 is provided with a portion to be detected 17 at a position opposite to an ink remaining amount detection sensor (which will be described hereinafter) provided in the apparatus side, when the ink container 1 is mounted to the apparatus. In this embodiment, the ink remaining amount detection sensor is in the form of a photo-sensor comprising a light emitting portion and a light receiving portion. The portion to be detected 17 is made of a transparent or semi-transparent material, and when the ink is not contained, the light from the light emitting portion is appropriately reflected toward the light receiving portion (which will be described hereinafter) by providing an inclined surface portion having a configuration, angle or the like for this purpose.

Figure 3:
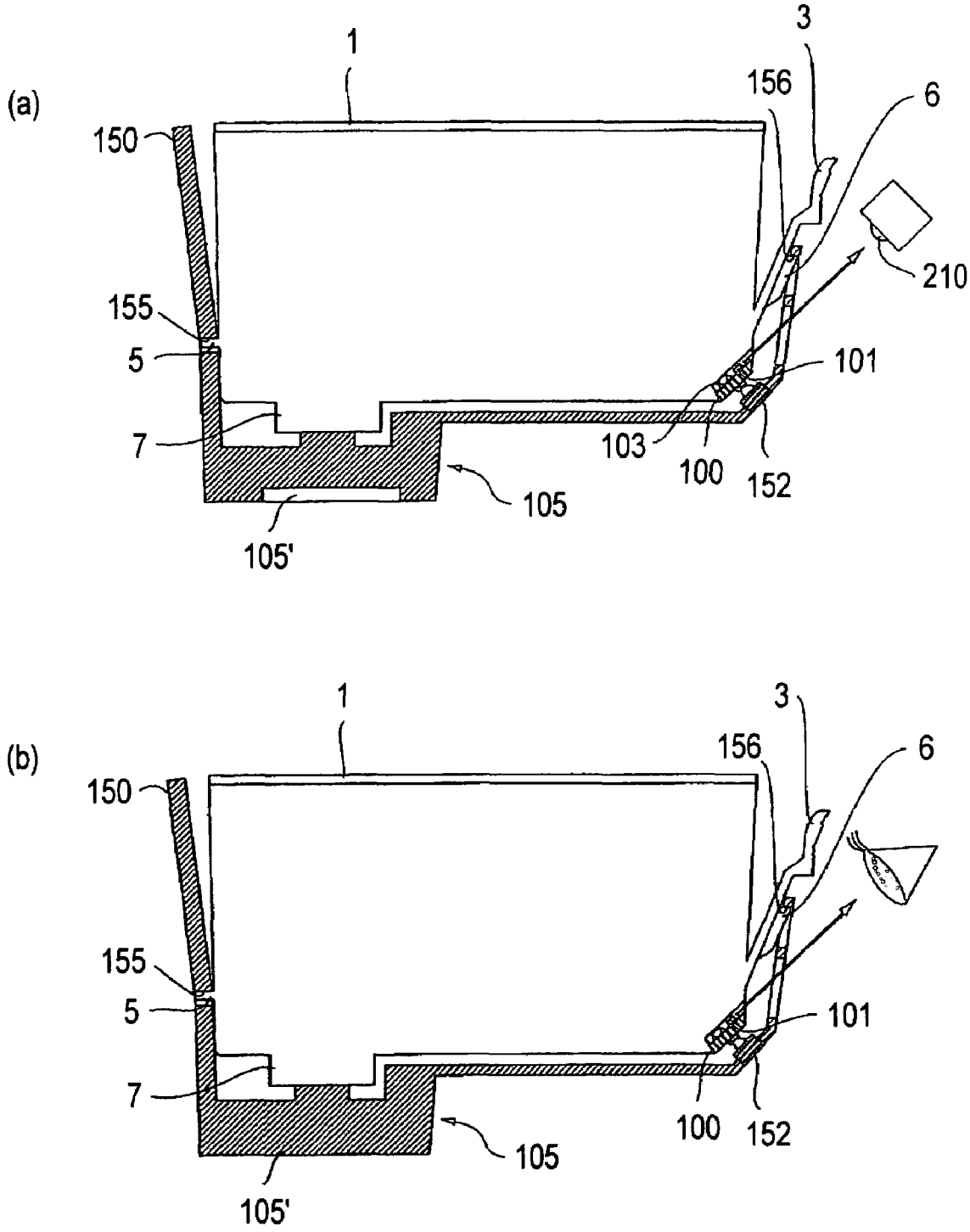
Figure 4:
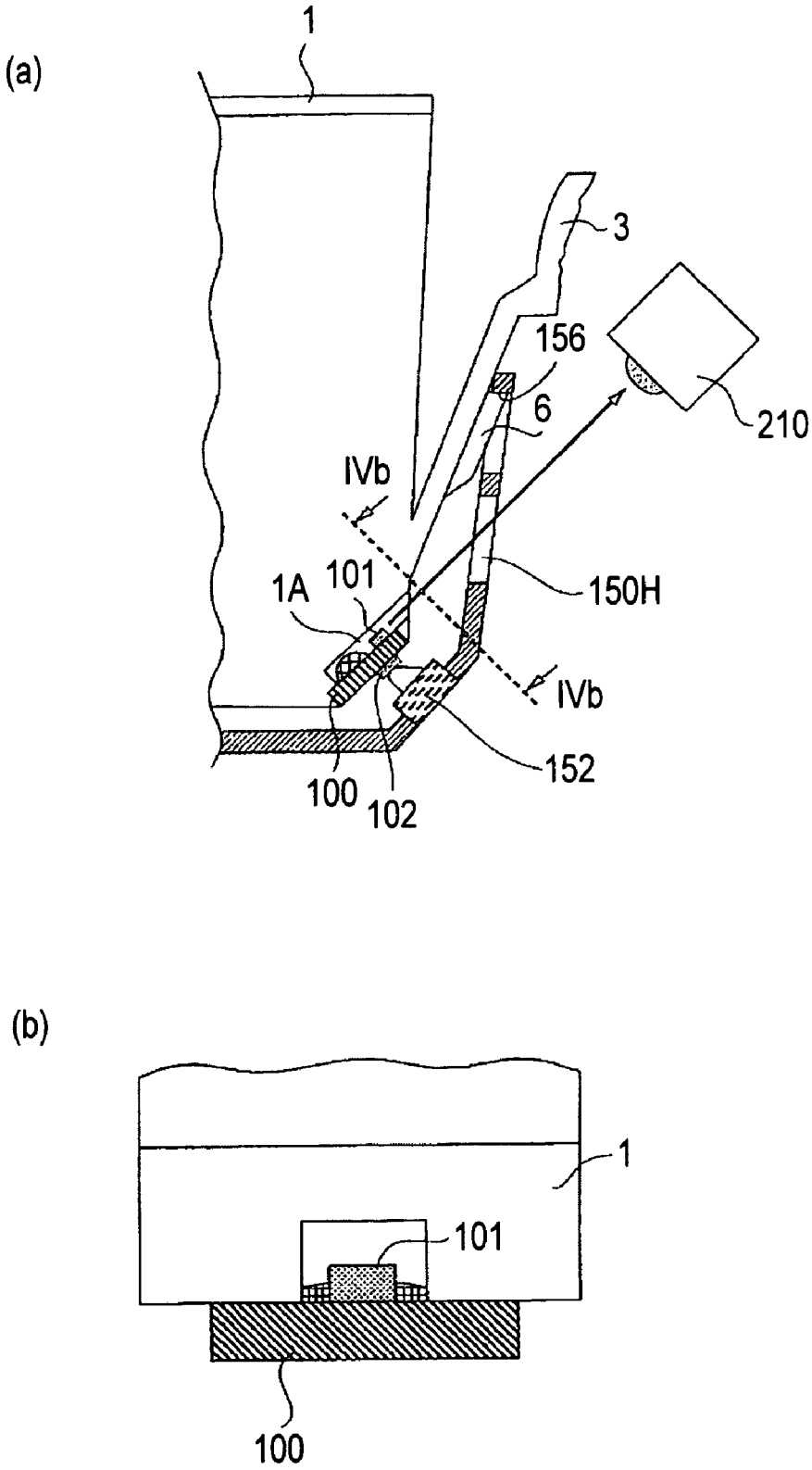
FIG. 4 is an enlarged view (a) of a major part of the ink container shown in FIG. 3, and a view (b) as seen in a direction IVb.
Figure 5:
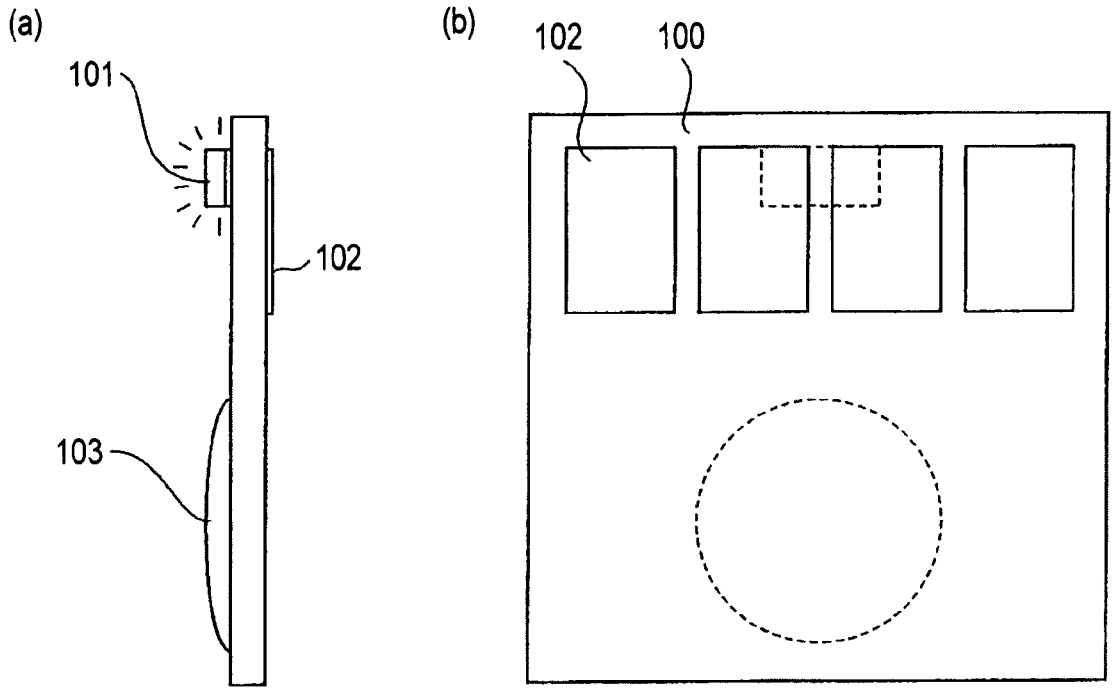

Referring to FIG. 3–FIG. 5, the description will be made as to the structure and the function of the substrate 100. FIG. 3 is schematic side views ((a) and (b)) of a substrate provided on the ink container which the present invention is applicable to. FIG. 4 is an enlarged view (a) of a major part of the ink container shown in FIG. 3, and a view (b) as seen in a direction IVb. FIG. 5 is a side view (a) and front view (b) of an example of controller substrate mounted to an ink container which the present invention is applicable to.

The ink container 1 is securedly mounted in or to the holder 150 which is integral with the recording head unit 105 having the recording head 105, by engagements of the first engaging portion 5 and the second engaging portion 6 of the ink container 1 with a first locking portion 155 and a second locking portion 156 of the holder 150, respectively. At this time, a contact (connector) 152 provided in the holder 150, and a contact in the form of an electrode pad 102 ((b) of FIG. 5) provided on a surface of the substrate 100 facing to outside, are electrically contacted to establish electrical connection.

A surface of the substrate 100 facing inwardly of the ink container 1 is provided with a first light emitting portion 101 such as a LED for emitting visible light and a control unit 103 for controling the light emitting portion, and the control unit 103 controls the light emission of the first light emitting portion 101 in accordance with the electric signal supplied through the connector 152 and the pad 102. In FIG. 5, (a) shows a state in which after the control unit 103 is set in the substrate 100, it is coated with a protecting sealant. When a memory element for storing information such as a color or the remaining amount of the ink contained in the ink container is employed, it is set at the same place, so that it is coated with the sealant.

Here, as described hereinbefore, the substrate 100 is disposed at a lower portion of the supporting portion of the supporting member 3 adjacent the portion where the sides of the ink container 1 constituting the bottom side and the front side cross with each other. At this position, an inclined surface is provided between the bottom and front sides of the ink container 1. Therefore, when the first light emitting portion 101 emits light, a part thereof is emitted outwardly from the front side of the ink container 1 along the inclined surface.

By this disposition of the substrate 100, the information relating to the ink container 1 can be directly provided not only to the recording device (and to a host apparatus such as a computer connected thereto) also to the user, by the first light emitting portion 101 alone. As shown by (a) in FIG. 3, the light receiving portion is disposed at a position for receiving the light emitted in an upper right direction in the Figure adjacent an end of a scanning range of the carriage for carrying the holder 150, and at the timing when the carriage comes to the position, the light emission of the first light emitting portion 101 is controlled, by which the recording device side can obtain predetermined information relating to the ink container 1 on the basis of a content of the light received by the light receiving portion. In addition, by controling the light emission of the first light emitting portion 101 with the carriage being disposed at a center portion of the scanning range, as shown by (b) in FIG. 3, the user is visually informed of the state of the light emission, so that user can be given the predetermined information relating to the ink container 1.

Here, the predetermined information of the ink container (liquid container) 1 includes at least one of properness of the mounting state of the ink container 1 (i.e. whether the mounting is mounting or not), properness of the position of mounting of the ink container 1 (i.e. whether or not the ink container 1 is mounted on the right position in the holder which is determined corresponding to the ink color), and. Sufficiency of the ink remaining amount (i.e. whether the remaining amount of the ink is sufficient or not). The information relating to them can be provided by emission or non-emission of the light and/or states of light emission (flickering or the like). The control of the light emission, the manners of providing the information will be described hereinafter in the description of the structure of the control system.

In FIG. 4, (a) and (b) show a preferable example of the disposition, the operation of the substrate 100, and the first light emitting portion 101. For the purpose of smooth reaching of the light light emitted from the first light emitting portion 101 into the view field of the first light receiving portion 210 or the user, it is preferable that such a portion of the ink container 1 as is opposed to the surface of the substrate 100 having the first light emitting portion 101 and the control unit 103 is provided with a space 1A at least along the optical axis, as indicated by the arrow. For the same purpose, the arrangement and the configuration of the supporting member 3 are so selected that optical axis is not blocked. In addition, the holder 150 is provided with a hole (or a light transmitting portion) 150H to assure non-blocking of the optical axis.

Figure 6:
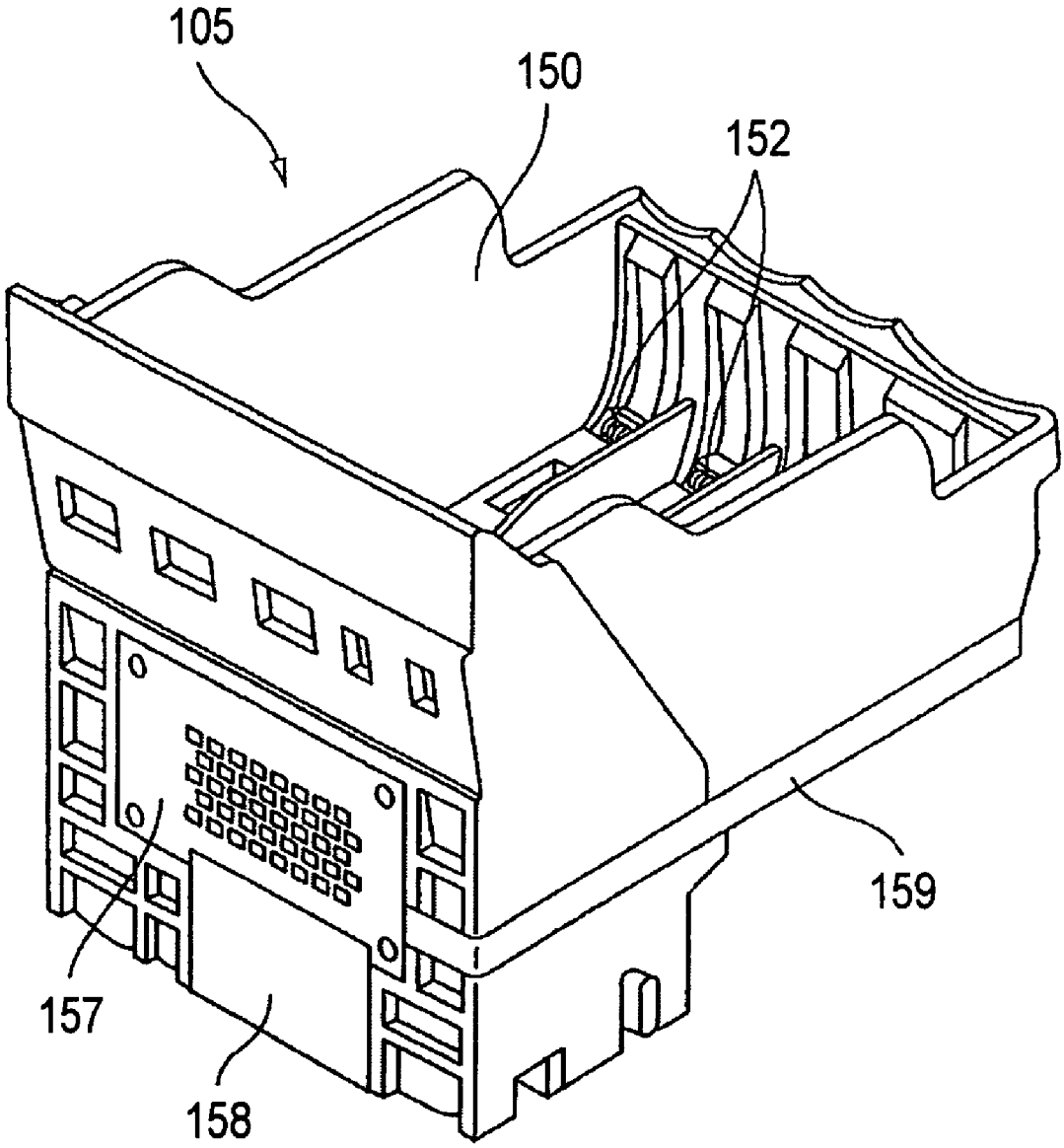
Figure 7:
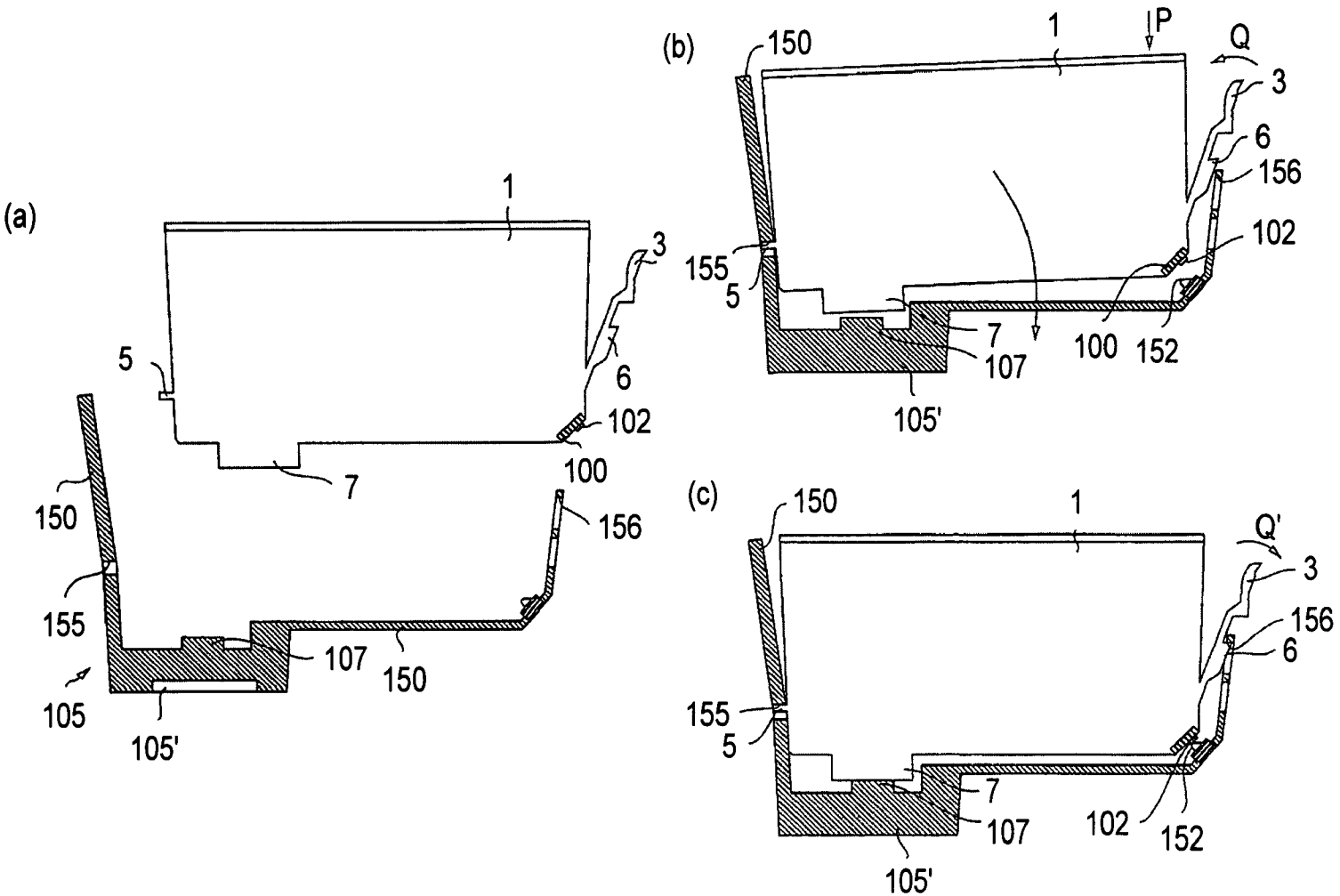
FIG. 7 is schematic side views ((a)–(c)) illustrating an operation when an ink container which the present invention is applicable to is mounted to and demounted from the holder of FIG. 14.
Figure 8:
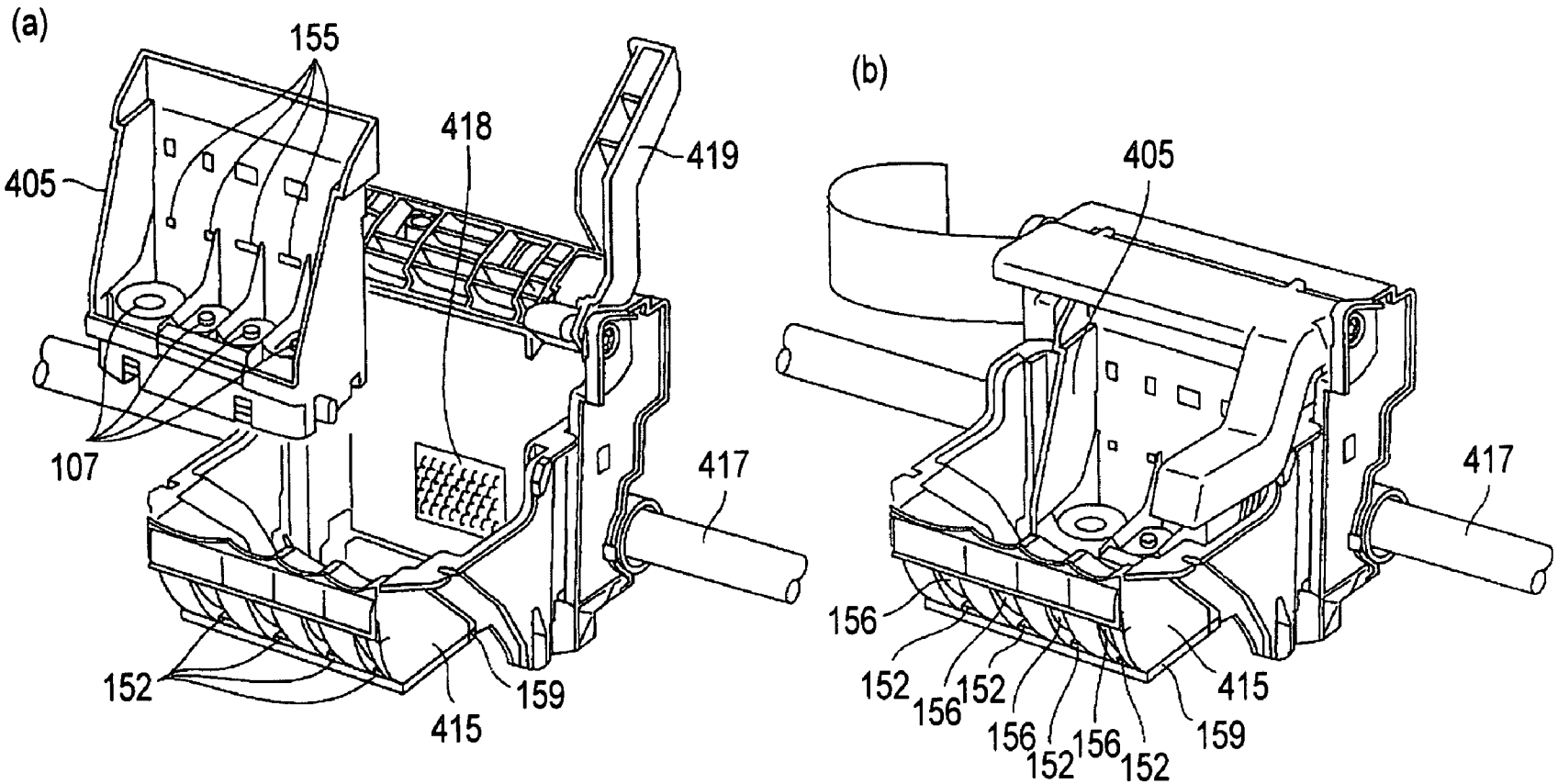

1.2 Mounting Portion of Ink Container (FIG. 6–FIG. 8:

FIG. 6 is a perspective view illustrating an example of a recording head unit having a holder to which the ink container according to the first embodiment is mountable.

Figure 14:
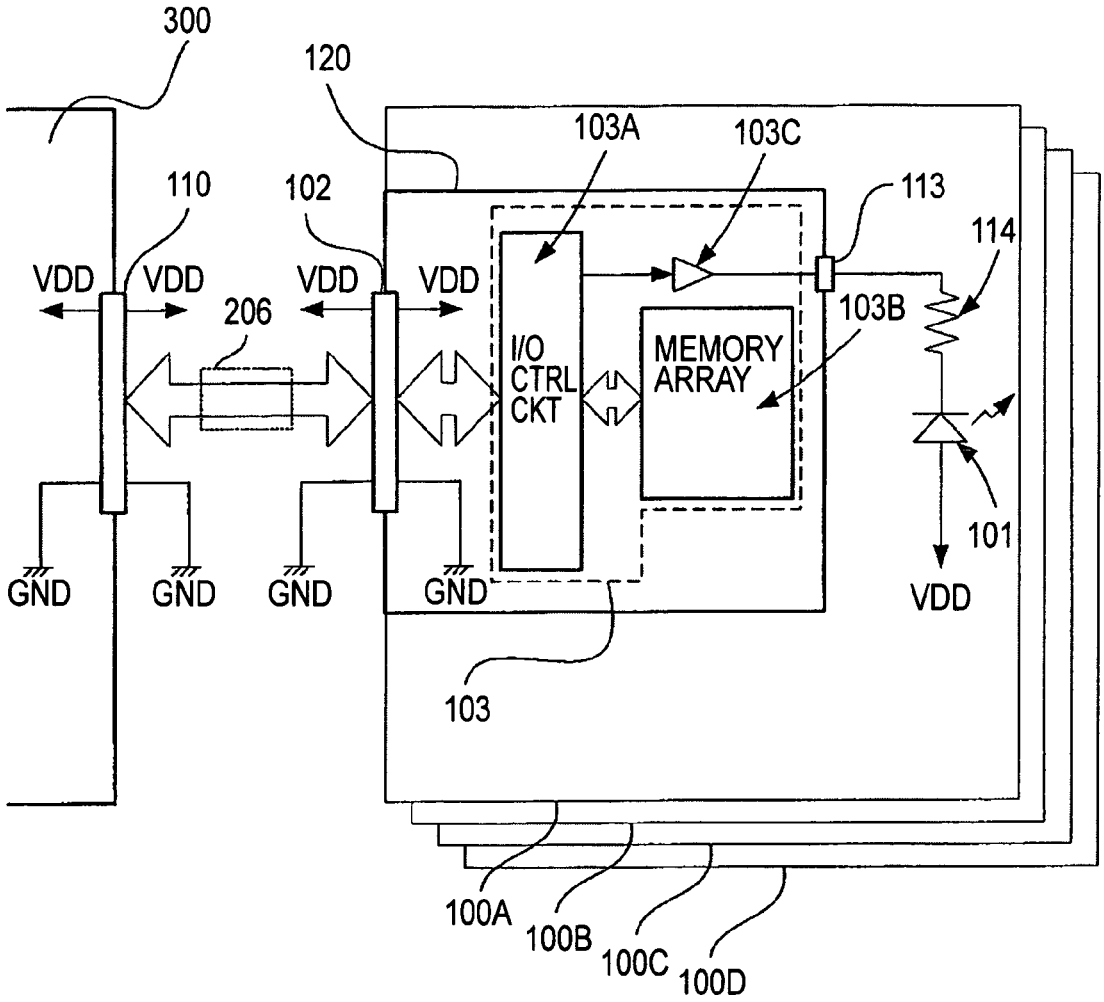
FIG. 14 is a circuit diagram showing a modified example of the structure of the substrate held in FIG. 13.

FIG. 7 is a schematic side view illustrating an operation of mounting and demounting (a)–(c) of the ink container according to the first embodiment to the holder shown in FIG. 14.

The recording head unit 105 is generally constituted by a holder 150 for detachably holding a plurality (four, in the example shown in the Figure) of ink containers, and a recording head 105 disposed adjacent the bottom side (unshown in FIG. 6). By mounting the ink container to the holder 150, an ink introduction opening 107 of the recording head disposed adjacent the bottom portion of the holder is connected with the ink supply port 7 of the ink container to establish an ink fluid communication path therebetween.

An example of usable recording head 105 comprises a liquid passage constituting a nozzle, an electrothermal transducer element provided in the liquid passage. The electrothermal transducer element is supplied with electrical pulses in accordance with recording signals, by which thermal energy is applied to the ink in the liquid passage. This causes a phase change of the ink resulting in bubble generation (boiling), and therefore, abrupt pressure rise, by which the ink is ejected from the nozzle. An electrical contact portion (unshown) for signal transmission provided on the carriage 203 which will be described hereinafter, and an electrical contact portion 157 of the recording head unit 105, are electrically contacted to each other, so that transmission of the recording signal is enabled to the electrothermal transducer element driving circuit of the recording head 105 through the wiring portion 158. From the electrical contact portion 157, a wiring portion 159 is extended to the connector 152.

When the ink container 1 is mounted to the recording head unit 105, the holder 150 is brought to above the holder 150 ((a) in FIG. 7), and a first engaging portion 5 in the form of a projection provided on an ink container rear side is inserted into a first locking portion 155 in the form of a through hole provided in a holder rear side, so that ink container 1 is placed on the inner bottom surface of the holder ((b) of FIG. 7). With this state kept, the front side upper end of the ink container 1 is pressed down as indicated by arrow P, by which the ink container 1 rotates in the direction indicated by the arrow R about the engaging portion between the first engaging portion 5 and the first locking portion 155, so that front side of the ink container displaces downwardly. In the process of this action, the supporting member 3 is displaced in the direction of an arrow Q, while a side surface of a second engaging portion 6 provided in the supporting member 3 on the ink container front side is being pressed to the second locking portion 156 provided on the holder front side.

When the upper surface of the second engaging portion 6 reaches a lower portion of the second locking portion 156, the supporting member 3 displaces in the direction Q' by the elastic force of the supporting member 3, so that second engaging portion 6 is locked with the second locking portion 156. With this state ((c) in FIG. 7), the second locking portion 156 elastically urges the ink container 1 in a horizontal direction through the supporting member 3, so that rear side of the ink container 1 is abutted to the rear side of the holder 150. The upward displacement of the ink container 1 is suppressed by. The first locking portion 155 engaged with the first engaging portion 5 and by the second locking portion 156 engaged with the second engaging portion 6. At this time, the mounting of the ink container 1 in addition completed, wherein the ink supply port 7 is connected with the ink introduction opening 107, and the pad 102 is electrically connected with the connector 152.

The above-described uses the principle of "lever" during the mounting process shown in (b) of FIG. 7, wherein the engaging portion between the first engaging portion 5 and the first locking portion 155 is a fulcrum, and the front side of the ink container 1 is a power point where the force is applied. The connecting portion between the ink supply port 7 and the ink introduction opening 107 is a working point which is located between the power point and the fulcrum, preferably, closer to the fulcrum. Therefore, the ink supply port 7 is pressed against the ink introduction opening 107 with a large force by the rotation of the ink container 1. At the connecting portion, an elastic member such as a filter, an absorbing material, a packing or the like which has a relatively high flexibility is provided to assure an ink communication property to prevent ink leakage there.

Such structure, arrangement and mounting operation are therefore preferable in that such a member is elastically deformed by the relatively large force. When the mounting operation is completed, the first locking portion 155 engaged with the first engaging portion 5 and the second locking portion 156 engaged with the second engaging portion 6 are effective to prevent the ink container 1 from rising away from the holder, and therefore, the restoration of the elastic member is suppressed, so that member is kept in an appropriately deformed elastically.

On the other hand, the pad 102 and the connector 152 (electrical contacts) are made of a relatively rigidity electroconductive material such as metal to assuring satisfy electrical connection property therebetween. On the other hand, an excessive contact force therebetween is not preferable from the standpoint of damage prevention and sufficient durability. In this example, they are disposed at a position as remote as possible from the fulcrum, more particularly, in the neighborhood of the front side of the ink container, in this example, by which the contact force is minimized.

To accomplish this, it is considered to place the pad of the substrate at a position very close to the front side on the bottom side of the ink container. Alternatively, it is considered to place the pad of the substrate on the front side of the ink container. In any case, however, some limitation is imparted to the disposition of the first light emitting portion 101 on the substrate, which should be selected such that light should properly reach the first light receiving portion 210 and the eyes of the user. In the case of placing the pad of the substrate at a position very close to the front side on the bottom side of the ink container, the pad 102 and the connector 152 approach to each other in a face-to-face fashion in the state immediately before completion of the mounting of the ink container 1, and they abut each other in such a state. A large mounting force is required in order to provide a satisfy electrical connection irrespective of the surface conditions of the pad and the connector, with a possible result of excessive force applied to the pad and to the connector. In case the ink leaks out at the connecting portion between the ink supply port 7 and/or the ink introduction opening 107, the leaked ink might reach the pad and/or the connecting portion along the bottom side of the ink container. When the substrate is disposed at the ink container front side, the disengagement of the ink container from the main assembly of the apparatus may be difficult.

In this example of the embodiment, the substrate 100 is disposed on the inclined surface connecting the bottom side of the ink container 1 with the front side of the ink container 1, namely, at the corner portion therebetween. When the balance of forces only at the contact portion in the state that pad 102 is contacted to the connector 152 immediately before the completion of mounting, is considered, it is such that reaction force (a upward force in the vertical direction) applied by the connector 152 to the pad 102, balancing with the mounting force applied downwardly in the vertical direction, involves a component force of the actual contact pressure between the pad 102 and the connector 152. Therefore, when the user presses the ink container down toward the mounting completion position, an addition of ink container mounting force for electrical connection between the substrate and the connector is small, so that operativity may be quite low.

When the ink container 1 is pressed down toward the mounting completion position where the first engaging portion 5 is engaged with each other, the second engaging portion 6 and the second locking portion 156 are engaged with each other, and there arises a component force (a force sliding the pad 102 on the connector 152) parallel with a surface of the substrate 100 by the urging force. Therefore, a good electrical connection property is provided and assured upon the completion of the mounting of the ink container. In addition, the electrical connecting portion is at a position high from the bottom side of the ink container, and therefore, the liability of the leaked ink reaching there is small. Furthermore, the optical axes toward the first light receiving portion 210 and toward the eyes of the user can be assured.

In this manner, the structure and arrangement of the electrical connecting portion described above is advantageous from the standpoint of assuring the optical path in the case that first light emitting portion 101 is used both for the first light receiving portion, for the eyes of the user, in addition, from the standpoint of the magnitude of the required ink container mounting force, assurance of the electrical contact state and the protection from contamination with the leaked ink.

The structure of the mounting portion for the ink container in the first embodiment or the modified example is not limited to that shown in FIG. 6.

Referring to FIG. 8, the description will be made as to this point. FIG. 8 is a perspective view (a) of another example of the recording head unit for executing the recording operation while being supplied with the ink from the ink container, and a carriage for carrying the recording head unit; and a perspective view wherein the ink container is carried on the carriage.

As shown in FIG. 8, the recording head unit 405 of this example is different from those (holder 150) described hereinbefore in that it does not have the holder portion corresponding to the ink container front side, the second locking portion or the connector. The recording head unit 405 is similar to the foregoing one in the other respects, the bottom side thereof is provided with an ink introduction opening 107 to be connected with the ink supply port 7. The rear side thereof is provided with the first locking portion 155, and the back side is provided with an electrical contact portion (unshown) for signal transmission.

On the other hand, as shown by (b) in FIG. 8, the carriage 415 is movable along a shaft 417, and is provided with a lever 419 for fixing the recording head unit 405, and an electrical contact portion 418 connected with the electrical contact portion of the recording head. The carriage 415 is also provided with a holder portion corresponding to the structure of the ink container front side. The second locking portion 156, the connector 152 and the wiring portion 159 to the connector, are provided on the carriage side.

With this structure, when the recording head unit 405 is mounted on the carriage 415, as shown by (b) in FIG. 8, the mounting portion for the ink container is established. In this manner, through the mounting operation which is similar to the example of FIG. 7, the connection between the ink supply port 7 and the ink introduction opening 107, and the connection between the pad 102 and the connector 152, are established, and the mounting operation is completed.

Figure 9:
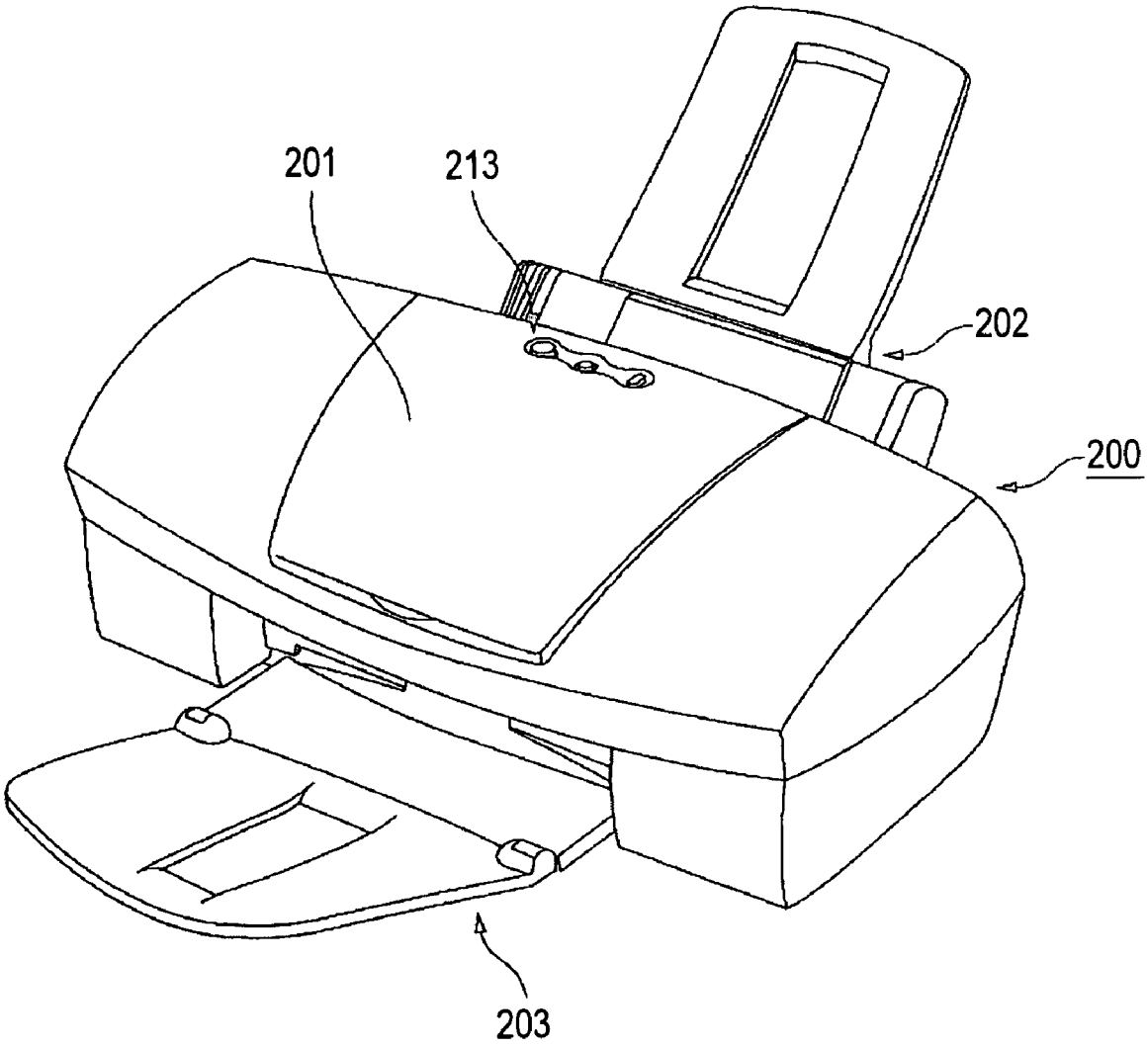
FIG. 9 shows an outer appearance of an ink jet printer which effects recording and on which the ink container which the present invention is applicable to is mounted.
Figure 10:
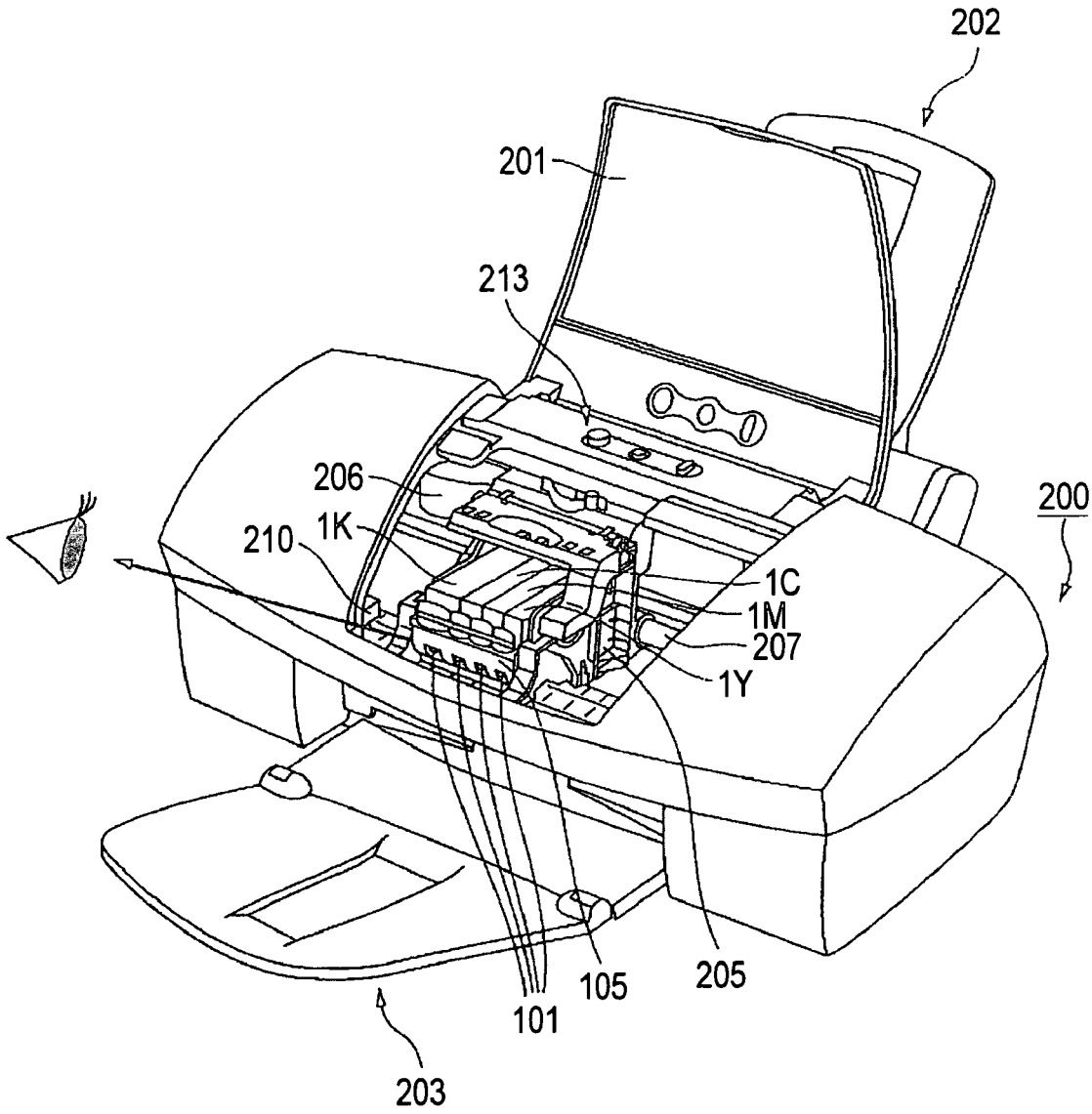
FIG. 10 is a perspective view of the printer in which the main assembly cover 201 of FIG. 17 is open.

1.4 Recording Device (FIGS. 9 and 10).

FIG. 9 shows an outer appearance of an ink jet printer 200 to which the ink container described in the foregoing. FIG. 10 is a perspective view of the printer in which the main assembly cover 201 of FIG. 9 is open.

Figure 17:
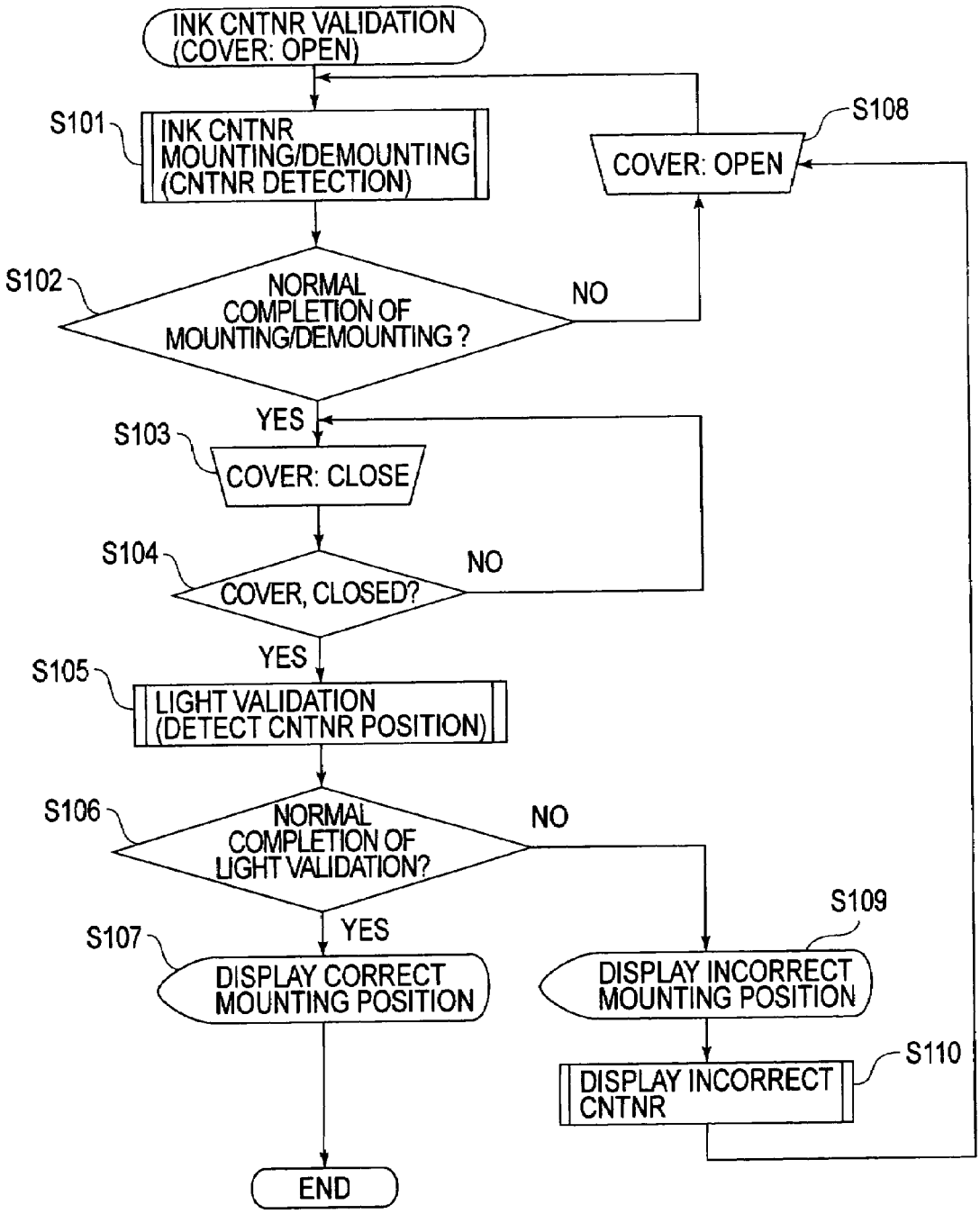
FIG. 17 is a flow chart showing a control process of mounting and demounting of the ink container according to an embodiment of the present invention.

As shown in FIG. 17, the printer 200 of this embodiment comprises a main assembly, a sheet discharge tray 203 at the front side of the main assembly, an automatic sheet feeding device (ASF) 202 at the rear side thereof, a main assembly cover 201, and other case portions which cover major parts including a mechanism for scanningly moving the carriage carrying the recording heads and the ink containers and for effecting the recording during the movement of the carriage. There is also provided an operating panel portion 213 which includes a displaying device which in turn displays states of the printer irrespective of whether the main assembly cover is closed or opened, a main switch, and a reset switch.

As shown in FIG. 10, when the main assembly cover 201 is open, the user can see the movable range, the neighborhood thereof which carries the recording head unit 105 and the ink containers 1K, 1Y, 1M and 1C (the ink containers may be indicated by reference numeral "1" only hereinafter for simplicity). In this embodiment, when the main assembly cover 201 is opened. A sequence operation is carried out so that carriage 205 is automatically comes to the center position ("container exchanging position", shown in the Figure), where the user can do the ink container exchanging operation or the like.

In this embodiment, the recording head (unshown) is in the form of a chip mounted to the recording head unit 105, corresponding to the respective inks. The recording heads scan the recording material by the movement of the carriage 205, during which the recording heads eject the ink to effect the printing. To do this, the carriage 205 is slidably engaged with the guiding shaft 207 which extends in the moving direction thereof, is driven by a carriage motor through a drive transmission mechanism. The recording heads corresponding to the K, Y, M and C (black, yellow, magenta and cyan) inks eject the inks on the basis of ejection data fed from a control circuit provided in the main assembly side through a flexible cable 206. There is provided a paper feeding mechanism including a paper feeding roller, a sheet discharging roller and so on to feed the recording material (unshown) fed from the automatic sheet feeding device 202 to the sheet discharge tray 203. The recording head unit 105 having an integral ink container holder is detachably mounted on the carriage 205, and the respective ink containers 1 are detachably mounted on the recording head unit 105. Thus, the recording head unit 105 can be mounted on the carriage 205, and the ink container 1 can be mounted on the recording head unit 105. In this embodiment, the ink container 1 is, therefore, detachably mountable to the carriage 205 by way of t recording head unit 105. In addition, by mounting t ink container 1 to the recording head unit 105, the liquid supplying system of the present invention is established.

During the recording or printing operation, the recording head scan the recording material by the above-described movement, during which the recording heads eject the inks onto the recording material to effect the recording on a width of the recording material corresponding to the range of the ejection outlets of the recording head. In a time period between a scanning operation and the next scanning operation, the paper feeding mechanism feeds the recording material through a predetermined distance corresponding to the width. In this manner, the recording is sequentially effected to cover the entire area of the recording material. An end portion of the movement range of the recording head by the movement of the carriage, there is provided an ejection refreshing unit including caps for capping the sides of the recording heads having the ejection outlets. Therefore, the recording heads move to the position of the refreshing unit at predetermined time intervals, and are subjected to the refreshing process including the preliminary ejections or the like.

Figure 18:
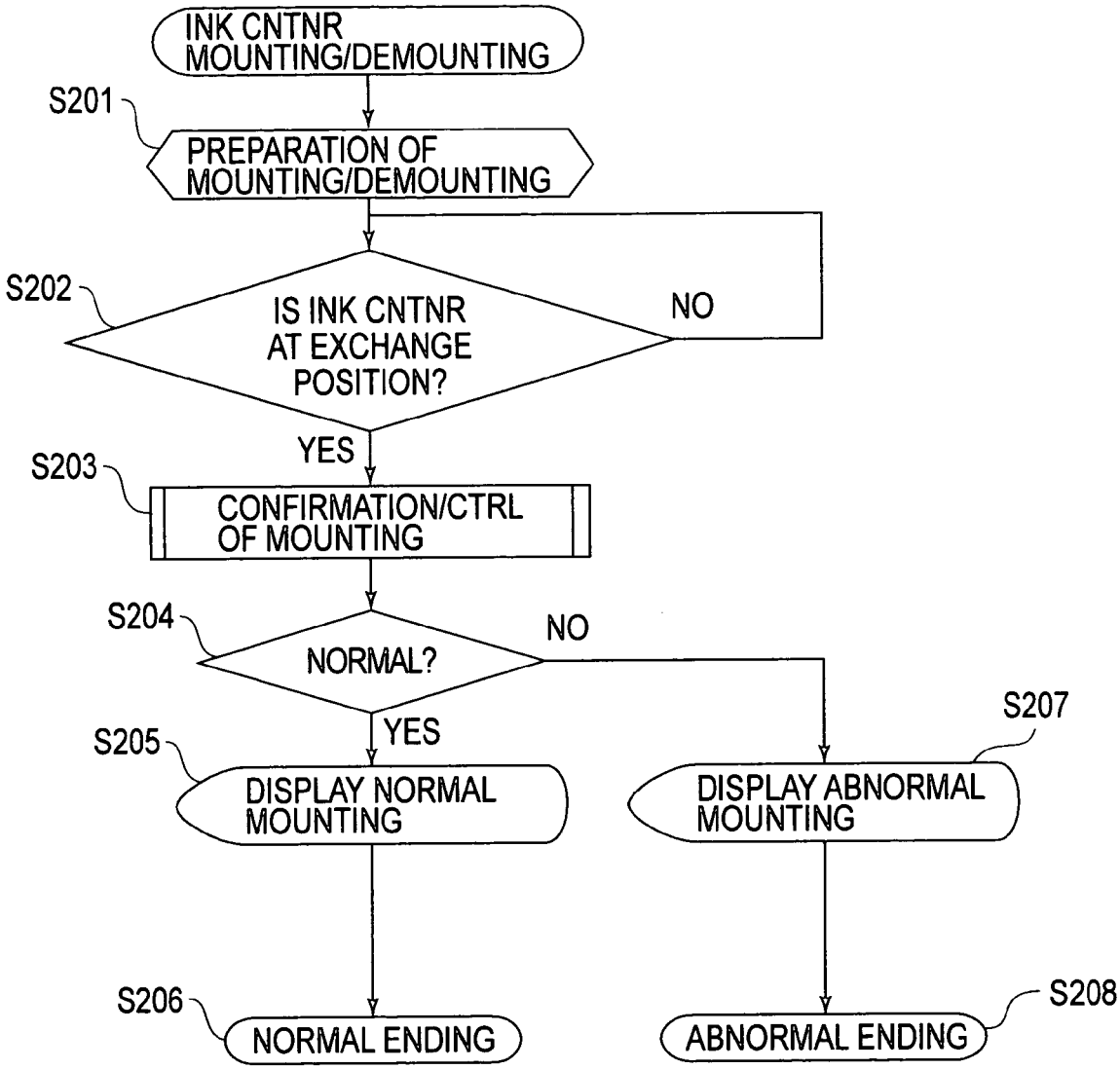
FIG. 18 is a flow chart showing details of the mounting and demounting process of the ink container of FIG. 17.
Figure 19:
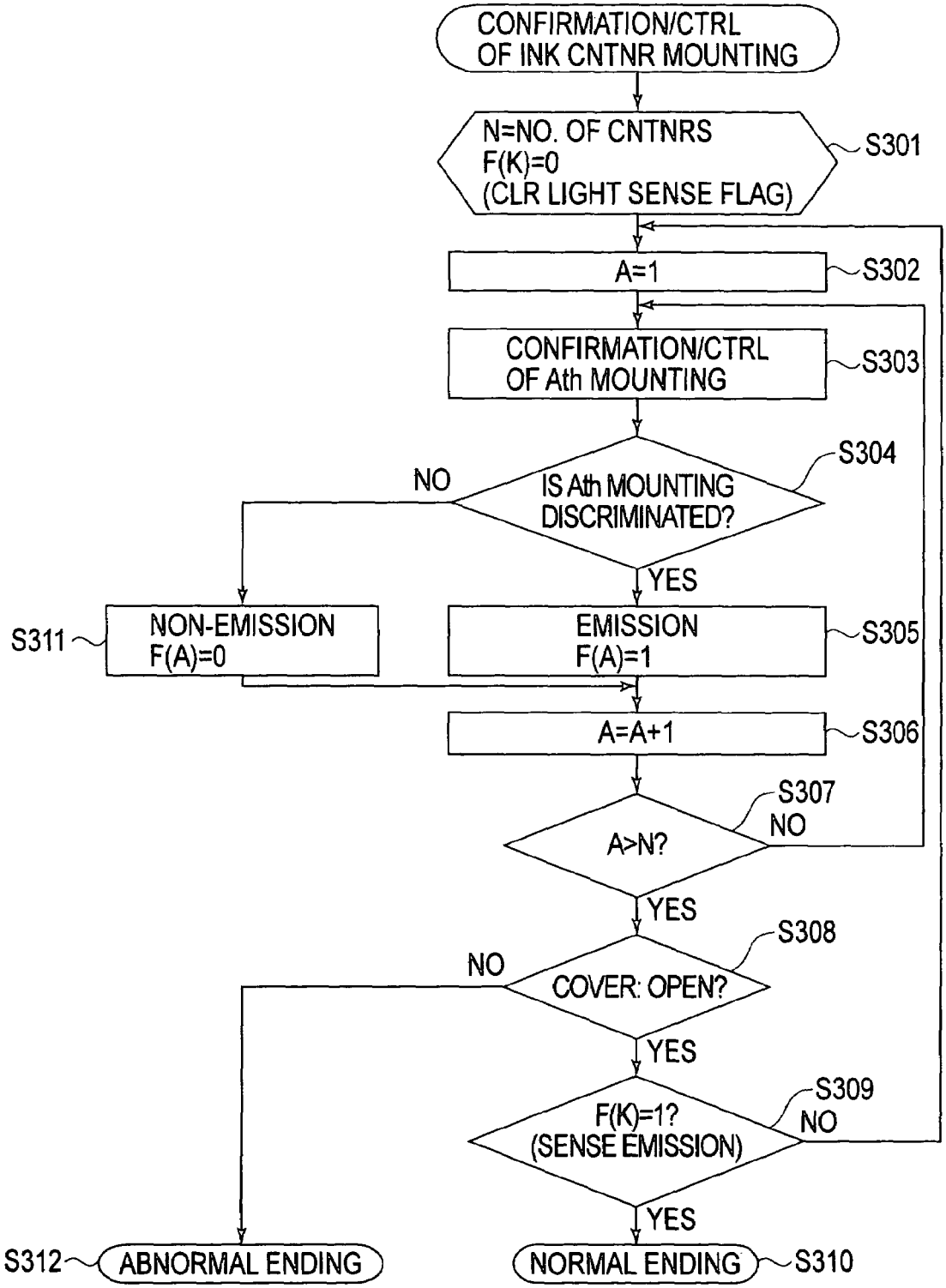
FIG. 19 is a flow chart showing details of a mounting confirmation control in FIG. 18.

The recording head unit 105 having a holder portion for each ink container 1, is provided with a connector corresponding to each of the ink containers, and the respective connectors are contacted to the pad of the substrate provided on the ink container 1. By this, the control of turn-on and -off of each of the LEDs 101 in accordance with the sequence which will be described hereinafter in conjunction of FIG. 17–FIG. 19, are enabled.

More particularly, at the container exchange position, when an ink remaining amount of an ink container 1 is short, the LED 101 of the ink container 1 is switched on or flickered. This applies to each of the ink containers 1. Adjacent to an end portion which is opposite the position where the refreshing unit is provided, a first light receiving portion 210 having a light receiving element is provided. When the LEDs 101 of the ink containers 1 pass by the light receiving portion 210 by the movement of the carriage 205, the LEDs 101 are switched on, and the light is received by the first light receiving position 210 so that positions of the ink containers 1 on the carriage 205 can be detected on the basis of the position of the carriage 205 when the light is received. In another example of the control for the turn-on of the LED or the like, the LED 101 of the container is switched on when the ink container 1 is correctly mounted at the container exchange position. These controls are executed, similarly to the control for the ink ejection of the recording head, by supplying control data (control signal) to the respective ink containers form the main assembly side control circuit through the flexible cable 206.

2. Control System:

2.1 General Arrangement (FIG. 11):

FIG. 11.

Figure 11:
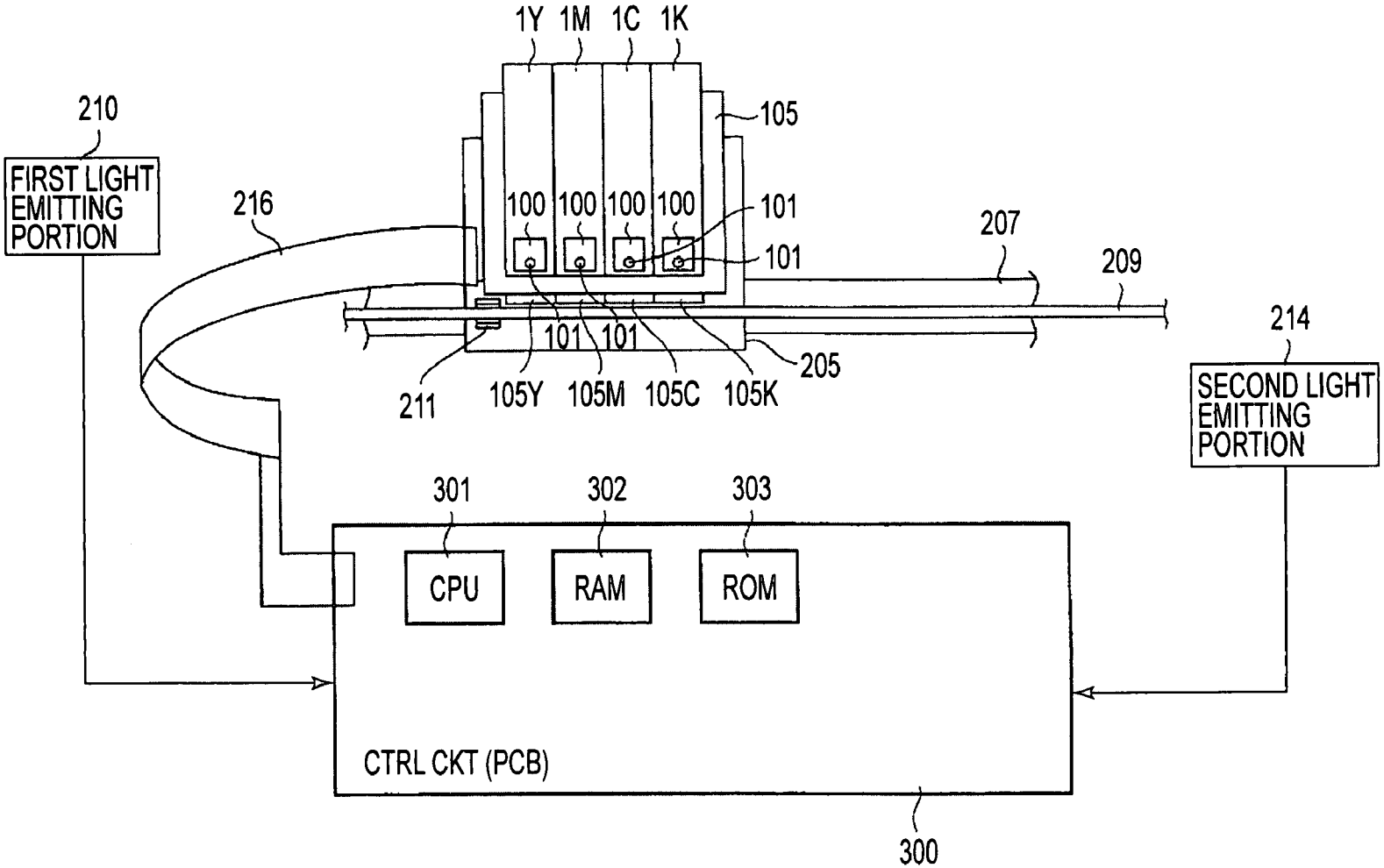
FIG. 11 is a block diagram showing a structure of a control system of the ink jet printer.

In FIG. 11, the control circuit 300 executes data processing relating to the printer and operation control. More particularly, a CPU 301 carried out processes which will be described hereinafter in conjunction with FIG. 17–FIG. 19 in accordance with a program stored in ROM 303. RAM 302 is used as a work area in the process execution of the CPU 301.

As schematically shown in FIG. 11, the recording head unit 105 carried on the carriage 205 has recording heads 105K, 105Y, 105M and 105C which have a plurality of ejection outlets for ejecting black (K), yellow (Y), magenta (M) and cyan (C) inks, respectively. On the holder of the recording head unit 105, ink containers 1K, 1Y, 1M and 1C are detachably mounted corresponding to the respective recording heads. The colors of the ink or the number of the ink container is not limited to those, and the same color inks with different density may be used.

Each of the ink container 1, as described hereinbefore, is provided with the substrate 100 provided with the LED 101, the display control circuit therefor and the pad (electric contact) or the like. When the ink container 1 is correctly mounted on the recording head unit 105, the pad on the substrate 100 is contacted to the connector provided corresponding to each of ink containers 1 in the recording head unit 105. The connector (unshown) provided in the carriage 205, the control circuit 300 provided in the main assembly side, are electrically connected for transmission of signals through the flexible cable 206. Furthermore, by the mounting of the recording head unit 105 on the carriage 205, the connector of the carriage 205 and the connector of the recording head unit 105 are electrically contacted with each other for signal transmission. With such a structure, the signals can be transmitted between the control circuit 300 of the main assembly side and the respective ink containers 1. Thus, the control circuit 300 can perform the control for turn-on and -off of LED in accordance with the sequence which will be described hereinafter in conjunction with FIG. 25–FIG. 27.

The control of ink ejections of the recording heads 105K, 105Y, 105M and 105C, is carried out similarly through the flexible cable 206, the connector of the carriage 205, the connector of the recording head unit with the signal connection between the driving circuit and so on provided in the recording head, and the control circuit 300 in the main assembly side. Thus, the control circuit 300 controls the ink ejections and so on for the respective recording heads.

The first light receiving portion 210 disposed adjacent one of the end portions of the movement range of the carriage 205 receives light from the LED 101 of the ink container 1, and a signal indicative of the event is supplied to the control circuit 300. The control circuit 300, as will be described hereinafter, responds to the signal to discriminate the position of the ink container 1 in the carriage 205. In addition, an encoder scale 209 is provided along the movement path of the carriage 205, and the carriage 205 is correspondingly provided with an encoder sensor 211. The detection signal of the sensor is supplied to the control circuit 300 through the flexible cable 206, by which the movement position of the carriage 205 is obtained. The position information is used for the respective recording head ejection controls, and is used also for light validation process in which the positions of the ink containers are detected, which will be described hereinafter in conjunction with FIG. 17. A second light emission/receiving portion 214 is provided in the neighborhood of the predetermined position in the movement range of the carriage 205, includes a light emitting element and a light receiving element, and it functions to output to the control circuit 300 a signal relating to an ink remaining amount of each of the ink container 1 carried on the carriage 205. The control circuit 300 can detect the ink remaining amount on the basis of the signal.

Figure 12:
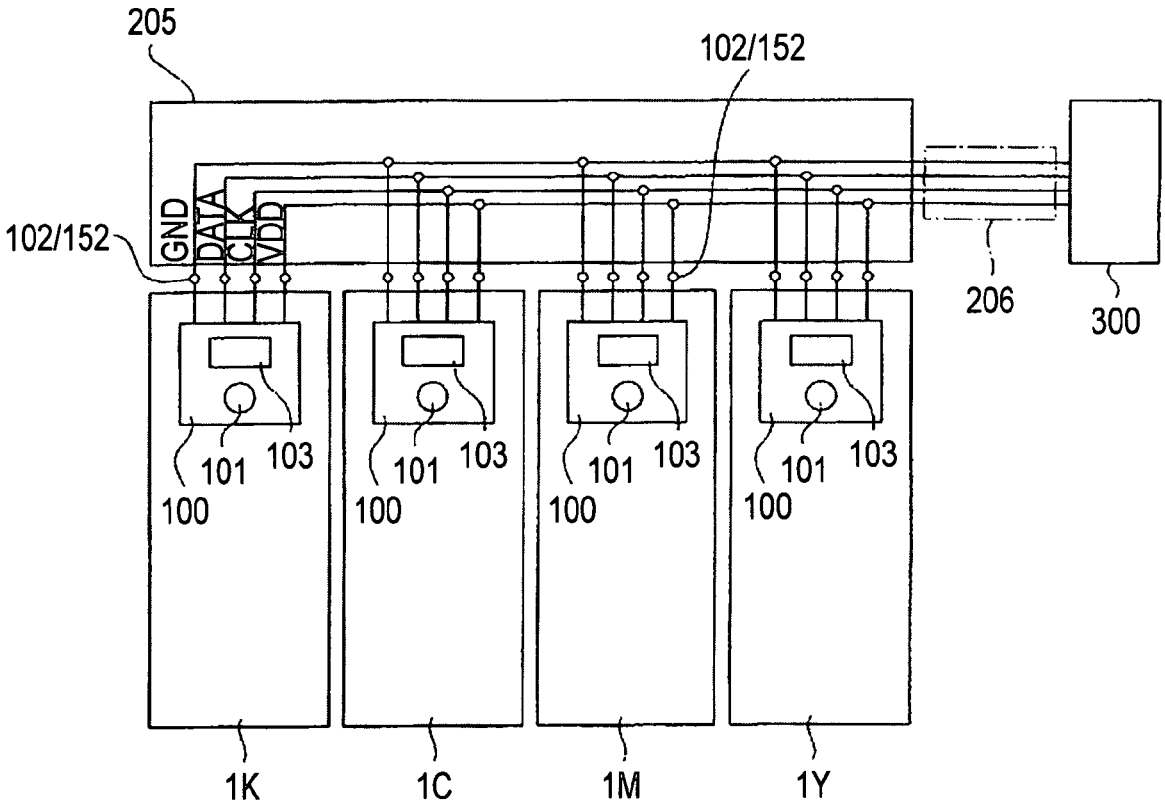
FIG. 12 shows structure of signal line wiring for signal transmission between the ink container and the flexible cable of the ink jet printer in terms of the substrate of the ink container.

2.2 Structure of Connecting Portion (FIG. 12).

Figure 20:
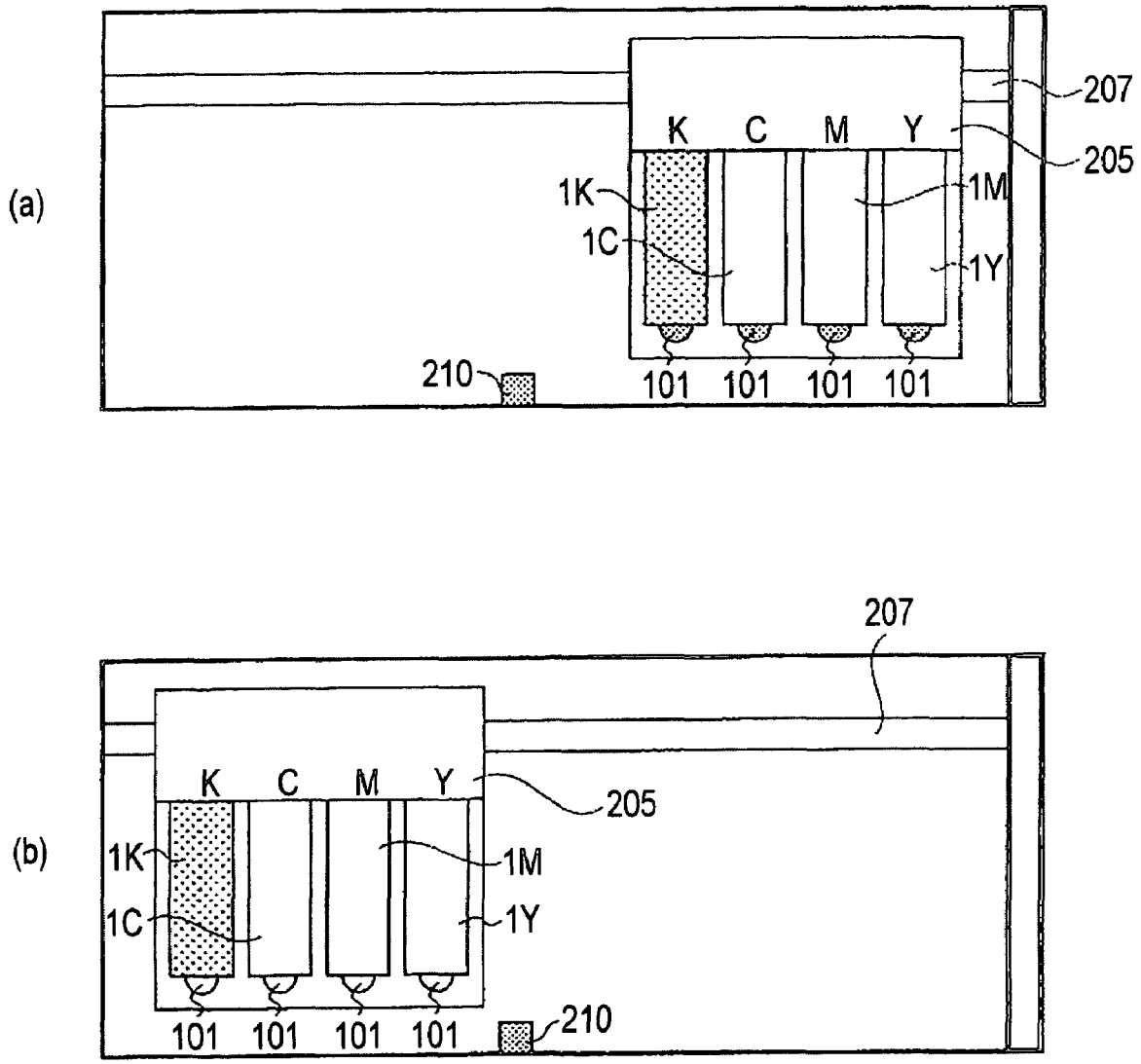
FIG. 20 shows a state (a) in which all of the ink containers are correctly mounted at correct positions, and therefore the LEDs are switched on, respectively, in the process of the control for the mounting and demounting of the ink containers, in which (b) shows movement of the carriage to a position for validation which is carried out using light (light validation), after the main assembly cover is closed subsequently to the LED lightening.

FIG. 12 FIG. 20 FIG. 20 shows a structure of signal line wiring for signal transmission between the ink container 1 and the flexible cable 206 of the ink jet printer in terms of the substrate 100 of the ink container 1.

As shown in FIG. 12, the signal line wiring for the ink container 1 comprises four signal lines in this embodiment, each of them is common for all of four ink containers 1 (bus connection). The signal line wiring for the ink containers 1 include four signal lines, namely, a voltage source signal line VDD relating to electric power supply such as for an operation of a control unit 103 for effecting light emission, actuation of the LED 101 in the ink container; a ground signal line GND; a signal line DATA for supplying control signal (control data), the like relating to the process such as turning-on and -off of the LED 101 from the control circuit 300; and a clock signal line CLK therefor.

Each of the substrates 100 of the ink containers 1 has a controller 103 which is responsive to the signal supplied through the four signal lines, and a LED 101 actuatable in response to the output of the controller 103. The foregoing is examples in which the ink container has a minimum number of connecting contacts, and with such examples, the LED 101 can be controlled, the information of the ink container can be obtained, and/or the information can be obtained or renewed, with a driving timing chart which will be described hereinafter in conjunction with FIGS. 15 and 16.

Figure 13:
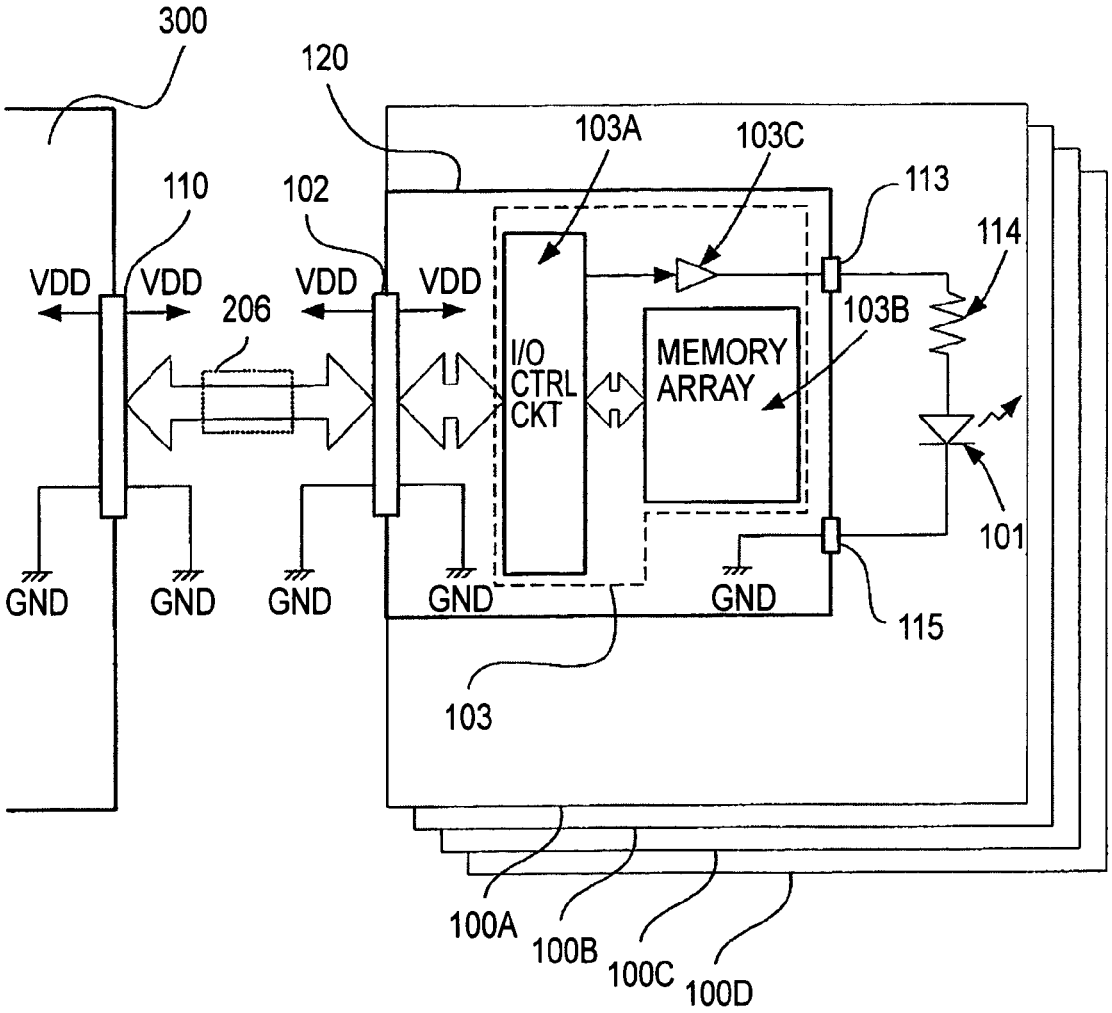

2.3 Structure of Controller (FIGS. 13 and 14).

FIG. 13 is a circuit diagram showing the details of one embodiment of the substrate on which a controller which the present invention is applicable to is provided. The description will be made with an ink container as the cartridge, an ink as the recording material and the light emitting diode (LED) as the light emitting portion. As shown in the Figure, the controlling unit 103 provided in the substrate 100A–100D on the ink container, comprises a semiconductor substrate 120 which has a memory array 103B (information storing portion), LED driver 103C (driver), and an I/O control circuit 103A for controling the memory array 103B and the LED driver 103C. The I/O control circuit 103A is responsive to control data fed through the flexible cable 206 from the control circuit 300 of the main assembly side to control the display driving of the LED 101 through the LED driver 103C for notifying operation, the writing of the data in the memory array 103B and the reading of the data. FIG. 13 is a block diagram, and therefore, the signal connection between the control circuit 300 of the main assembly side and the substrate 100A of the ink container side, are shown in a simplified manner. Actually, however, the control data fed form a control signal connector 110 in the main assembly side through the flexible cable 206 are not transmitted directly to the substrate 100A–100D on the ink container, but they are transmitted through an electrical contact portion for signal transmission provided in the carriage 203, the electrical contact portion 157 on the recording head unit 105 side, or the like.

The memory array 103B is in the form of an EEPROM in this embodiment, and is able to store individual information of the ink container, such as information relating to the ink remaining amount in the ink container, the color information of the ink therein, and in addition, manufacturing information such as a number of the ink container, production lot number or the like. The color information is written in a predetermined address of the memory array 103B corresponding to the color of the ink stored in the ink container. The color information is used as ink container discrimination information (individual information) which will be described hereinafter in conjunction with FIGS. 15 and 16 to identify the ink container when the data is written in the memory array 103B and is read out therefrom, or when the actuation and deactuation of the LED 101 is controlled for the particular ink container.

The data written in the memory array 103B or read out of it include, for example, the data indicative of the ink remaining amount. The ink container of this embodiment, as described hereinbefore, is provided in the bottom portion with a prism, and when the remaining amount of the ink becomes small, the event can be optically detected by means of the prism. In addition to that, the control circuit 300 of this embodiment counts the number of ejections for each of the recording heads on the basis of the ejection data The remaining amount information is written in the memory array 103B of the corresponding ink container, and the information is read out. By doing so, the memory array 103B stores the information of the ink remaining amount in real time. The information represents the ink remaining amount with high accuracy since the information is provided with the aid of the prism, too. Also, it is possible to use it to discriminate whether the mounted ink container is a fresh one, or used and then remounted one.

A LED driver 103C functions to apply a power source voltage to the LED 101 to cause it to emit light when the signal supplied from the I/O control circuit 103A is at a high level. Therefore, when the signal supplied from the I/O control circuit 103A is at a high level, the LED 101 is in the on-state, and when the signal is at a low level, the LED 101 is in the off-state.

Designated by reference numeral 113 is a contact for connecting an anode side of the LED101 to the LED driver 102C on the semiconductor substrate 120; 115 is a contact for connecting the cathode side of the LED101 to the ground line of the semiconductor substrate 120. Designated by reference numeral 114 is a limiting resistor for determining a current supplied to the LED101, and is electrically interposed between the output side of the LED driver 103C and the anode side of the LED114. The limiting resistor 114 may be provided in the substrate 100A–100D on the ink container or may be built in the semiconductor substrate 120.

FIG. 14 a circuit diagram of a modified example of the substrate of FIG. 13. This modified example is different from the example of FIG. 13 in the structure for applying the power source voltage to the LED 101, more particularly, the voltage source voltage is supplied from the VDD voltage source pattern provided inside the substrate 100 of the ink container. It is ordinary that respective elements constituting the controlling unit 103 are built in the semiconductor substrate 120 all together, and the connecting contact means connected to the LED 101 is only the connecting contact 113. Reduction of the number of the connecting contacts by only one is significantly influential to the area occupied by the semiconductor substrate 120, so that cost reduction of the semiconductor substrate 120 is significant.

Figure 15:
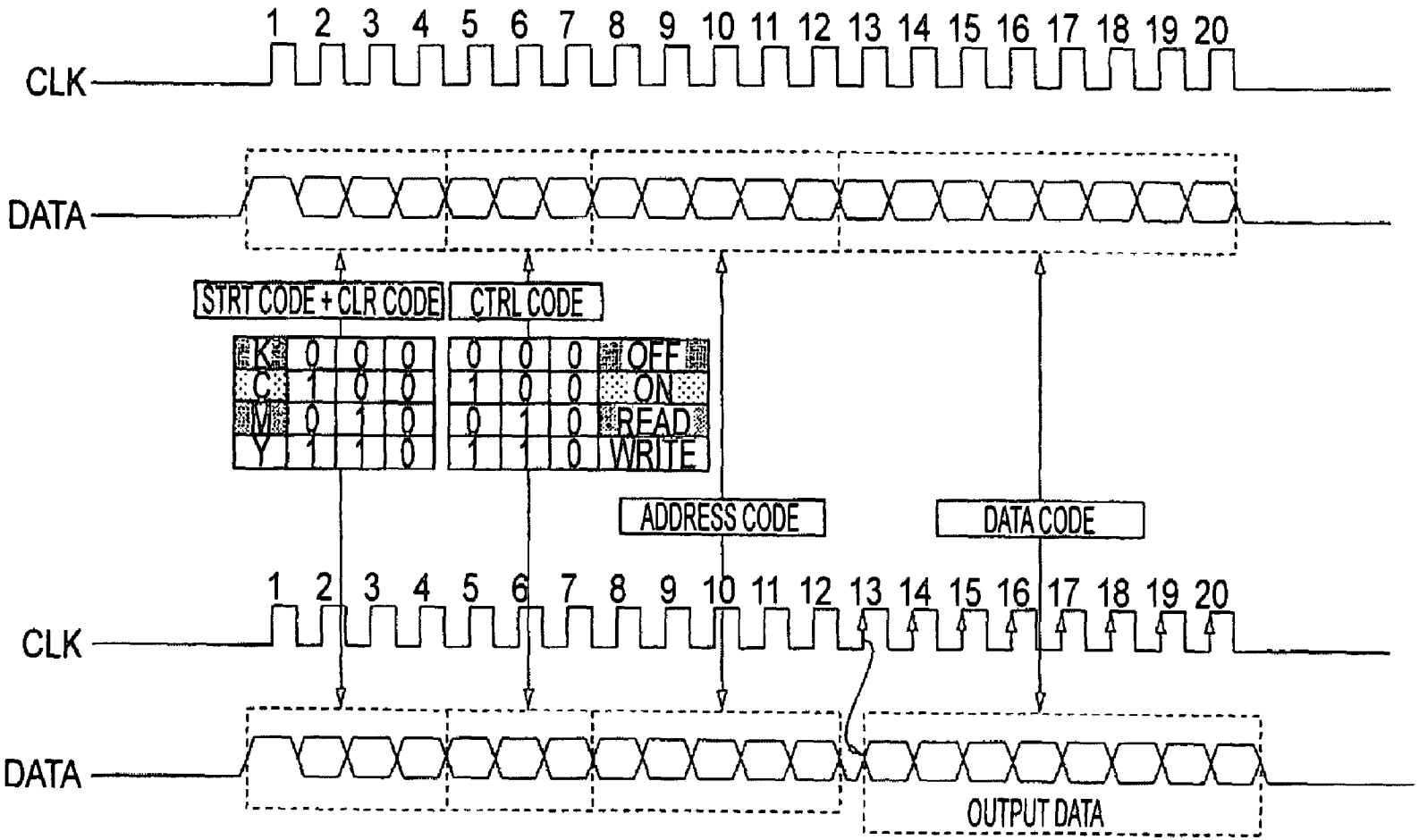
FIG. 15 is a timing chart illustrating the data writing and reading operations to and from a memory array of the substrate.

Operation of Controller (FIGS. 15 and 16):

FIG. 15 memory array 103B of the substrate.

Figure 16:
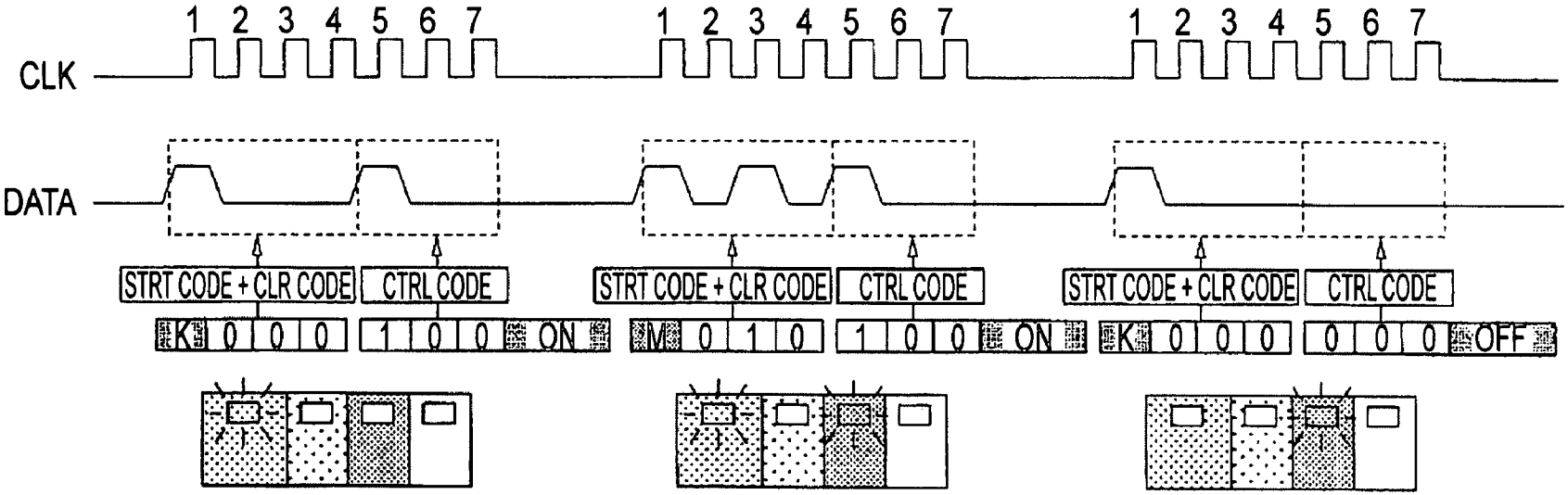
FIG. 16 is a timing chart illustrating actuation and deactuation of LED 101.

FIG. 16 is a timing chart illustrating actuation, deactuation of LED 101.

As shown in FIG. 15, in the writing in the memory array 103B, start code plus color information, control code, address code, data code, are supplied in the order named from the control circuit 300 in the main assembly side through the signal line DATA (FIG. 12) to the I/O control circuit 103A in the controller 103 of the ink container 1 in synchronism with the clock signal CLK. The start code signal in the start code plus color information indicates the begining of the series of the data signals, and the color information signal is effective to identify the particular ink container which the series of data signal are related to.

As shown in the Figure, the color information has a code corresponding to each colors of the ink, K, C, M and Y. The I/O control circuit 103A compares the color information indicated by the code with the color information stored in the memory array 103B of the ink container per se. Only if they are the same, the subsequent data are taken in, and if not, the subsequent data are ignored. In this embodiment, the color information corresponding to the information supplied from the recording device. By doing so, even when the data signal is supplied commonly to all of the ink containers from the main assembly side through the common signal line DATA held in FIG. 12, the ink container to which the data are concerned can be correctly identified since the data include the color information, and therefore, the processing on the basis of the subsequent data, such as the writing, reading of the subsequent data, actuation, deactuation of the LED, can be effected only to the identified ink container (that is, only to the right ink container). As a result, (one) common data signal line is enough for all of the four ink containers to write the data in, to actuate the LED and to deactuate the LED, thus reducing the required number of the signal lines. As will be readily understood, (one) common data signal line is enough irrespective of the number of the ink containers.

As shown in FIG. 15, the control modes of this embodiment include OFF and ON codes for actuation and deactuation of the LED which will be described hereinafter, and READ and WRITE codes for for access to the memory array, that is, for reading out of the memory array and writing therein. In the writing operation, the WRITE code follows the color information code for identifying the ink container. The next code, i.e., the address code indicates an address in the memory array in which the data are to be written in, and the last code, i.e., the data code indicates the content of information to be written in.

In this embodiment, these codes correspond to the commands from the recording device. The content indicated by the control code is not limited to the example described above, and, for example, control codes for verification command and/or continuous reading command may be added.

For the reading operation, the structure of the data signal is the same as in the case of the writing operation. The code of the start code plus color information is taken by the I/O control circuit 103A of all of the ink containers, similarly to the case of the writing operation, and the subsequent data signal are taken in only by the I/O control circuit 103A of the ink container having the same color information. What is different is that. The read data are outputted in synchronism with rising of the first clock (13th clock in FIG. 23) after the address is designated by the address code. Thus, the I/O control circuit 103A effects control to prevent interference of the read data with another input signal even though the data signal contacts of the ink containers are connected to the common (one) data signal line.

LED101 As shown in FIG. 16, with respect to the actuation (turning-on) and the deactuation (turning-off) of the LED 101, the data signal of the start code plus color information is first sent to the I/O control circuit 103A through the signal line DATA from the main assembly side, similarly to the foregoing. As described hereinbefore, the right ink container is identified on the basis of the color information, and the actuation and deactuation of the LED 101 by the control code fed subsequently, are effected only for the identified ink container. The control codes for the actuation and the deactuation, as described hereinbefore in conjunction with FIG. 15, include one of ON code and OFF code which are effective to actuate and deactuate the LED 101, respectively. Namely, when the control code indicates ON, the I/O control circuit 103A outputs an ON signal to the LED driver 103C, as described hereinbefore in conjunction with FIG. 13, the output state is continuously maintained thereafter. On the contrary, when the control code indicates OFF, the I/O control circuit 103A outputs an OFF signal to the LED driver 103C, and the output state is continuously maintained thereafter. The actual timing for the actuation or deactuation of the LED 101 is after 7th clock of the clock CLK for each of the data signals.

In the example of this Figure, the black (K) ink container which the leftmost data signal designates is first identified, and then, the LED 101 of the black ink K container is switched on. Then, the color information of the second data signal indicates magenta ink M, and the control code indicates actuation, and therefore, the LED 101 of the ink M container is switched on while the LED 101 of the ink K container is kept in ON state. The control code of the third data signal means instruction of deactuation, and only the LED 101 of the ink K container is deactuated.

As will be understood from the foregoing description, the flickering control of the LED is accomplished by the control circuit 300 of the main assembly side sending repeated actuation and deactuation control codes alternately for the identified ink container. The cyclic period of the flickering can be determined by selecting the cyclic period of the alternating control codes.

2.5 Control Process (FIG. 17–FIG. 23):

FIG. 17 is a flow chart illustrating control processes relating the mounting and demounting of the ink container according to the embodiment of the present invention, and particularly shows the actuation and deactuation control for the LED 101 of each of the ink containers 1K, 1Y, 1M and 1C by the control circuit 300 provided in the main assembly side.

The process shown in FIG. 17 starts in response to the user opening the main assembly cover of the printer 201 (FIGS. 9, 10) which is detected by a predetermined sensor. When the process is started, the ink container is mounted or demounted by step S101.

FIG. 18 is a flow chart of a mounting and demounting process of the ink container. As shown in the Figure, in the mounting or demounting process, the carriage 205 moves at step S201, and the information of the state of ink container (individual information thereof) carried on the carriage 205 is obtained. The information of the state to be obtained here is an ink remaining amount or the like which is read out of the memory array 103B together with the number of the ink container. In step S202, the discrimination is made as to whether the carriage 205 reaches the ink container exchange position having been described in conjunction with FIG. 9 or not.

If the result of the discrimination is affirmative, step S203 is executed for ink container mounting confirmation control.

FIG. 19 is a flow chart showing in detail the mounting confirmation control. First, in step S301, a parameter N indicative of the number of the ink container carried on the carriage 205 is set, and a flag F (k) for confirmation of light emission of the LED correspondingly to the number of the ink container, is initialized. In this embodiment, N is set to 4 since the number of the ink containers is 4 (K, C, M, Y). Then, four flags F (k), k=1–4 are prepared, and they are all initialized to zero.

In step S302, a variable An of the flag relating to the order of mounting discrimination for the ink container is set to "1", and in step S303, the mounting confirmation control is effected for the Ath ink container. In this control, the contact 152 of the holder 150 and the contact 102 of the ink container are contacted with each other by the user mounting the ink container to the right position in the holder 150 of the recording head unit 105, by which the control circuit 300 of the main assembly side, as described hereinbefore, identifies the ink container by the color information (individual information for the ink container), and the color information stored in the memory array 103B of the identified container is sequentially read out. The color information for the identification is not used for the already read out one or ones. In this control process, the discrimination is also made as to whether or not the read color information is different from the color information already read out after the start of this process.

In step S304, if the color information have been able to read out, the color information has been different from the already read out piece or pieces of information, it is then discriminated that ink container of the color information is mounted as the A-th ink container. Otherwise, it is discriminated that A-th ink container is not mounted. Here, the "A-th" represents only the order of discrimination of the ink container, does not represent the order indicative of the mounted position of the ink container. When the A-th ink container is discriminated as being correctly mounted, the flag F (A) (the flag satisfying k=An among the prepared flags flag F (k), k=1–4) is set to "1" in step S305, as described hereinbefore in conjunction with FIG. 16, and the LED 101 of the ink container 1 having the corresponding color information is switched on. When it is discriminated that ink container is not mounted, the flag F (A) is set to "0" in step S311.

Then, in step S306, the variable An is incremented by 1, and in step S307, the discrimination is made as to whether or not the variable An is larger than N set in the step S301 (in this embodiment, N=4). If the variable An is not more than N, the process subsequent to step S303 is repeated. If it is discriminated as being larger than N, the mounting confirmation control has been completed for all of four ink containers. Then, in step S308, the discrimination is made as to whether or not the main assembly cover 201 is in an open position on the basis of an output of the sensor. When the main assembly cover is in a closed state, an abnormality state is returned to the processing routine of FIG. 18 in step S312 since there is a possibility that user has closed the cover although one of some of the ink containers are not mounted or are not properly mounted. Then, this process operation is completed.

When, on the contrary, the main assembly cover 201 is discriminated as being open in the step S308, the discrimination is made as to whether or not all of the four flags F (k), k=1–4 are "1", that is, whether the LEDs 101 are all switched on or not. If it is discriminated that at least one of the LEDs 101 is not switched on, the process subsequent to the step S302 is repeated. Until the user mount or correctly remount the ink container or ink containers of which the LEDs 101 are not switched on, the LED of the ink container or containers is switched on, and the process operation is repeated.

In an alternative, if step S309 discriminates that not all of the LEDs are switched on, the lighted on LED or LEDs are flickered to notify the user of the fact the there is at least one unmounted or incompletely mounted (the contact 152 of the holder 150 and the contact 102 of the ink container 1 are not electrically contacted to each other) ink container.

When all of the LEDs are discriminated as being switched on, a normal ending operation is carried out in step S310, and this process operation is completed. Then, the process returns to the processing routine shown in FIG. 18. FIG. 20 shows a state (a) in which all of the ink containers are correctly mounted at correct positions, and therefore, the LEDs are all switched on, respectively.

Referring back to FIG. 18, after the ink container mounting confirmation control (step S203) is executed in the above-described manner, the discrimination is made as to whether or not the control is normally completed, namely, whether or not the ink containers are properly mounted, in step S204.

If the mountings are discriminated as being normal, the displaying device (FIG. 9 and FIG. 10) in the operating portion 213 is lighted green, for example, and in step S205, a normal ending is executed at step S206, and the operation returns to the example shown in FIG. 17. When the abnormality mounting is discriminated, the displaying device in the operating portion 213 is flickered orange, for example, in step S207, and the abnormality ending is carried out, and then, the operation returns the processing routine shown in FIG. 17. When the printer is connected with a host PC which controls the printer, the mounting abnormality display is also effected on the display of the PC simultaneously.

In FIG. 17, when the ink container seating process of step S101 is completed, the discrimination is made as to whether or not the mounting or demounting process is properly completed in step S102. If the abnormality is discriminated, the process operation waits for the user to open the main assembly cover 201, and in response to the opening of the cover 201, the process of the step S101 is started, so that process described in conjunction with FIG. 18 is repeated.

When the proper mounting or demounting process is discriminated in step S102, the process waits for the user to close the main assembly cover 201 in step S103, and the discrimination is made as to whether or not the cover 201 is closed or not in step S104. If the result of the discrimination is affirmative, the operation proceeds to light validation process of step S105. In this case, if the closing of the main assembly cover 201 is detected as shown by (b) in FIG. 20, the carriage 205 moves to the position for light validation, and the LEDs 101 of the ink containers are deactuated.

The light validation process is intended to discriminate whether or not the properly mounted ink containers are mounted at the correct positions, respectively. In this embodiment, the structures of the ink containers are not such that configurations thereof are made peculiar depending on the colors of the ink contained therein for the purpose of preventing the ink containers from being mounted at wrong positions. This is for the simplicity of manufacturing of the ink container bodies. Therefore, there is a possibility that ink containers are mounted at wrong positions. The light validation process is effective to detect such wrong mounting and to notify the user of the event. By this, the efficiency and low cost of the ink container manufacturing are accomplished since it is not required to make the configurations of the ink containers different from each other depending on the colors of the ink.

Figure 21:
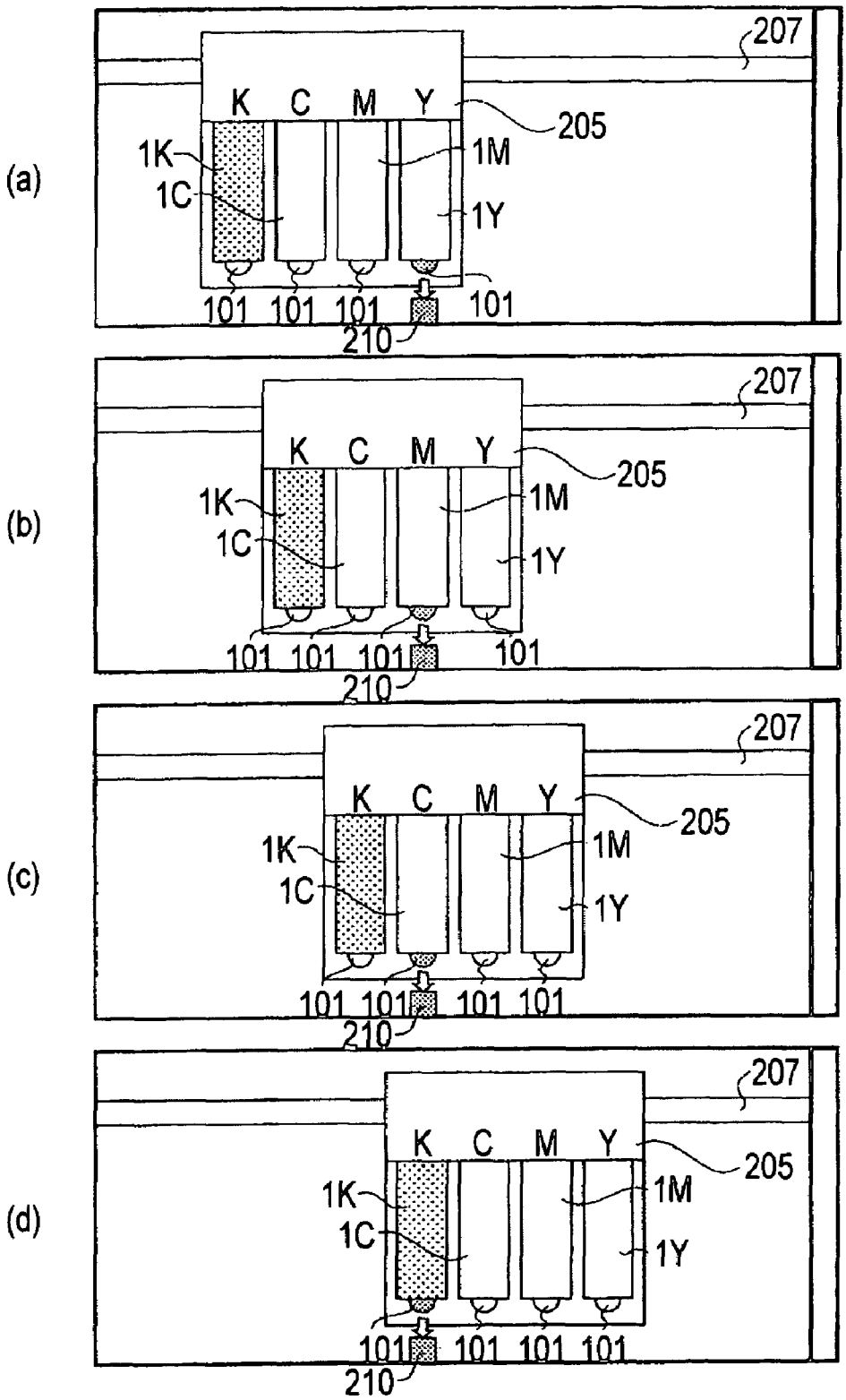
FIG. 21 illustrates the light validation process (a)–(d).

FIG. 21 illustrates the light validation process (a)–(d).

Figure 22:
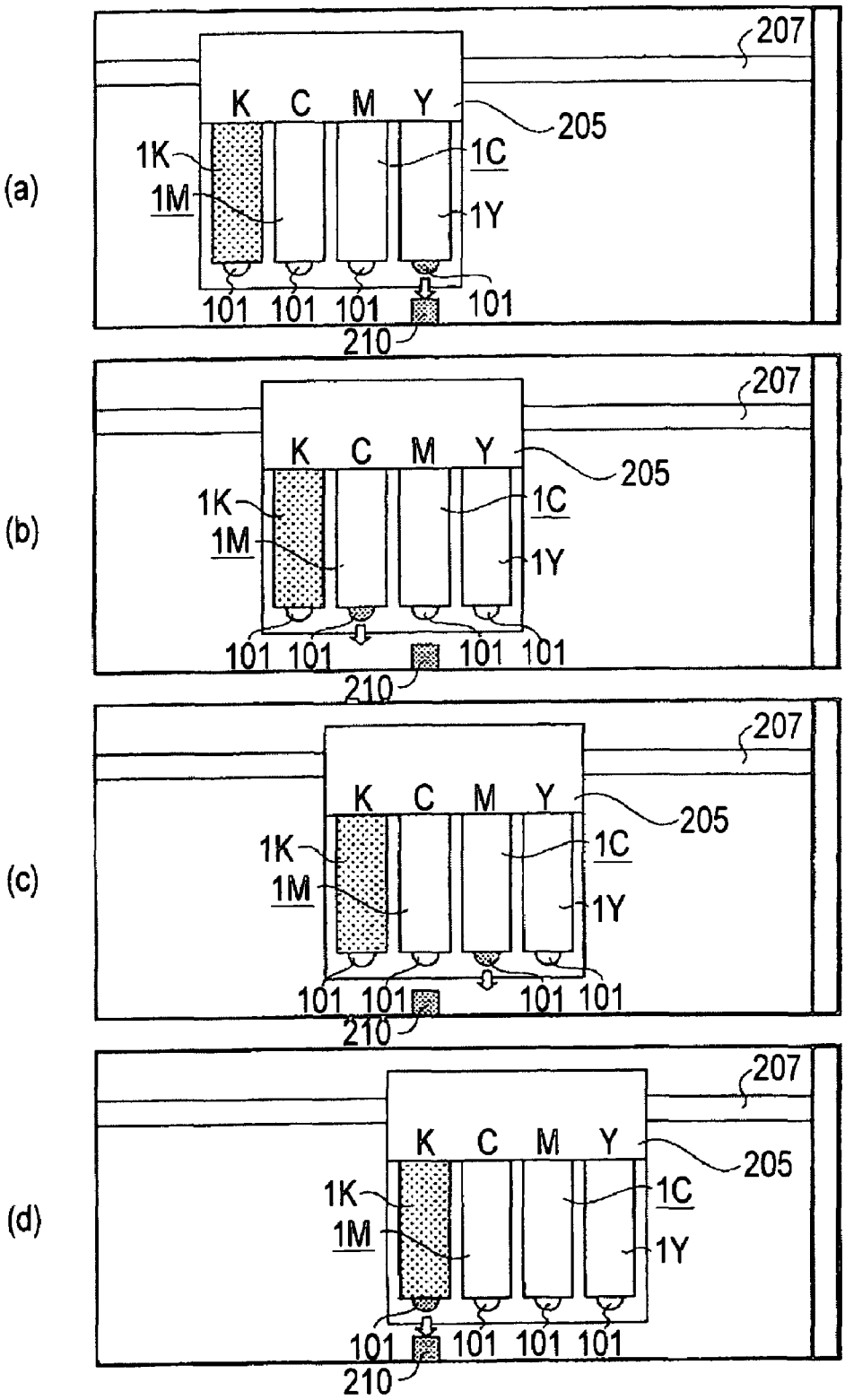
FIG. 22 also illustrates the light validation process (a)–(d).

FIG. 22 also illustrates the light validation process (a)–(d).

As shown by (a) in FIG. 21, the movable carriage 205 first starts moving from the lefthand side to the righthand side in the Figure toward the first light receiving portion 210. When the ink container placed at the position for a yellow ink container comes opposed to the first light receiving portion 210, a signal for actuating the LED 101 of the yellow ink container is outputted in order to switch it on for a predetermined time duration, by the control having been described in conjunction with FIG. 16. When the ink container is placed at the correct position, the first light receiving portion 210 receives the light from the LED 101, so that control circuit 300 discriminates that ink container 1Y is mounted at the correct position.

While moving the carriage 205, as shown by (b) in FIG. 21, when the ink container placed at the position for a magenta ink container comes opposed to the first light receiving portion 210, a signal for actuating the LED 101 of the magenta ink container is outputted to switch it on for a predetermined time duration, similarly. In the example shown in the Figure, the ink container 1M is mounted at the correct position, so that first light receiving portion 210 receives the light from the LED. As shown by (b)–(d) in FIG. 21, the light is emitted sequentially, while changing the position of discrimination. In this Figure, all of the ink containers are mounted at correct positions.

On the contrary, if a cyan ink container IC is erroneously mounted at a position for a magenta ink container 1M, as shown by (b) in FIG. 20, the LED 101 of the ink container 1C which is opposed to the first light receiving portion 210 is not actuated, but the ink container 1M mounted at another position is switched on. As a result, the first light receiving portion 210 does not receive the light at the predetermined timing, so that control circuit 300 discriminates that mounting position has an ink container other than the ink container 1M (right container). If a magenta ink container 1M is erroneously mounted at a position for a cyan ink container 1C, as shown by (c) in FIG. 20, the LED 101 of the ink container 1M which is opposed to the first light receiving portion 210 is not actuated, but the ink container 1C mounted at another position is switched on.

In this manner, the light validation process with the control circuit 300 described above is effective to identify the ink container or ink containers not mounted at the correct position. If the mounting position does not have the correct ink container mounted thereto, the color of the ink container erroneously mounted there can be identified by sequentially actuating the LEDs of the other three color ink containers.

In FIG. 17, after the light validation process in the step S105, the discrimination is made as to whether or not the light validation process is properly completed or not in step S106. When the proper completion of the light validation is discriminated, the displaying device in the operating portion 213 is lighted up green, for example, in step S107, and the process ends. On the other hand, if the ending is discriminated as being abnormal, the displaying device in the operating portion 213 is flickered orange at step S109, and the LED 101 of the ink container which is not mounted at the correct position and which has been identified in the step S105 is flickered or switched on in step S105. In this manner, when the user opens the main assembly cover 201, the user is notified of the ink container which is not mounted at the correct position, so that user is prompted to remount it to the correct position.

Figure 23:
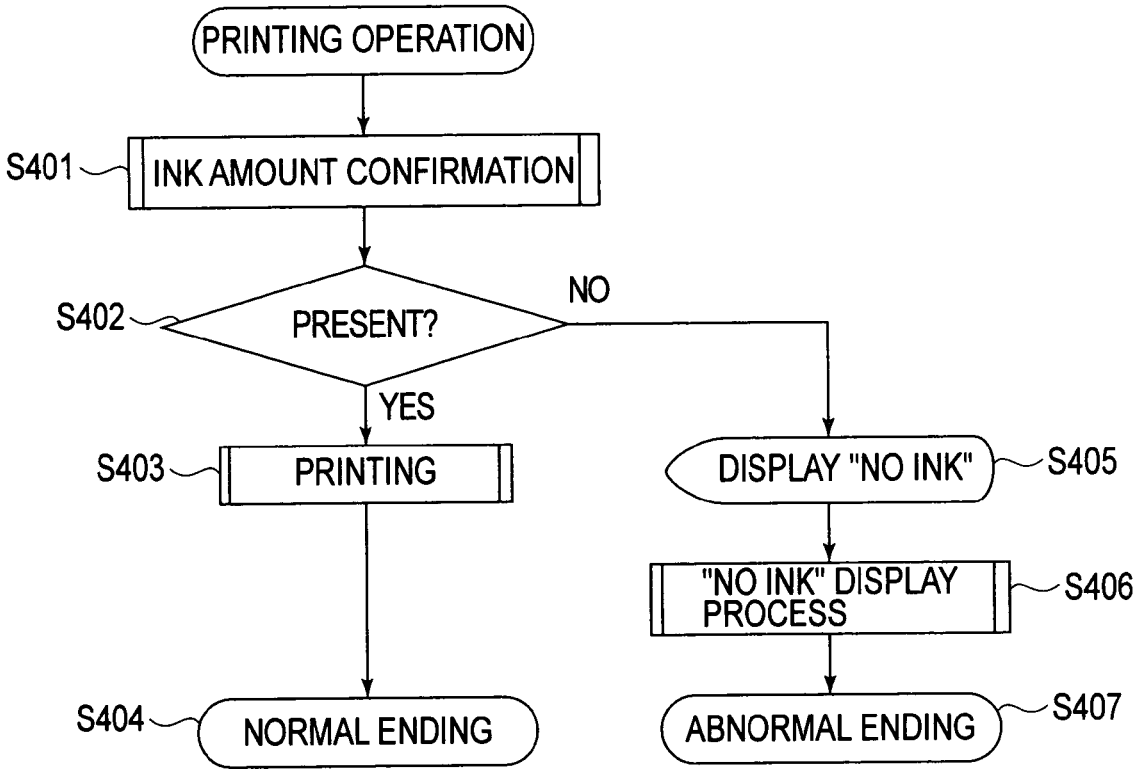
FIG. 23 is a flow chart showing the recording process according to this embodiment of the present invention.

FIG. 23 FIG. 23*q* is a flow chart illustrating a recording process according to the embodiment of the present invention. In this process, the ink remaining amount is first checked in step S401. In this process, an amount of printing is determined from the printing data of the job for which the printing is going to be effected, and the comparison is made between the determined amount and the remaining amount of the ink container to check whether the remaining amount is sufficient or not (confirmation process). In this process, the ink remaining amount is the amount detected by the control circuit 300 on the basis of the counting.

In step S402, the discrimination is made as to whether the remaining ink amount is sufficient to the printing or not, on the basis of the confirmation process. If the ink amount is sufficient, the operation goes to the printing in step S403, and the displaying device of the operating portion 213 is lighted green at step S404 (normal ending). On the other hand, if the result of the discrimination at the step S402 indicates a shortage of the ink, the displaying device of the operating portion 213 is flickered orange in the step S405, and in step S406, the LED 101 of the ink container 1 containing the insufficient amount of the ink is flickered or switched on (abnormal ending).

With the above-described structure, even if there is no display function in the recording device per se or in a host computer controling the recording device, or even if they are not used, the user can confirm the information relating to the ink container by the display function provided in the ink container per se. As described in the foregoing, with the structure of the foregoing embodiments, not only the remaining service life of the cartridge and the timing of cartridge exchange, but also the information indicative of the properness of the mounting can be notified to the user utilizing the light emitting portion. The manner of utilization of the light emitting portion is wide ranging, and the possibility of utilization is wide.

Figure 25:
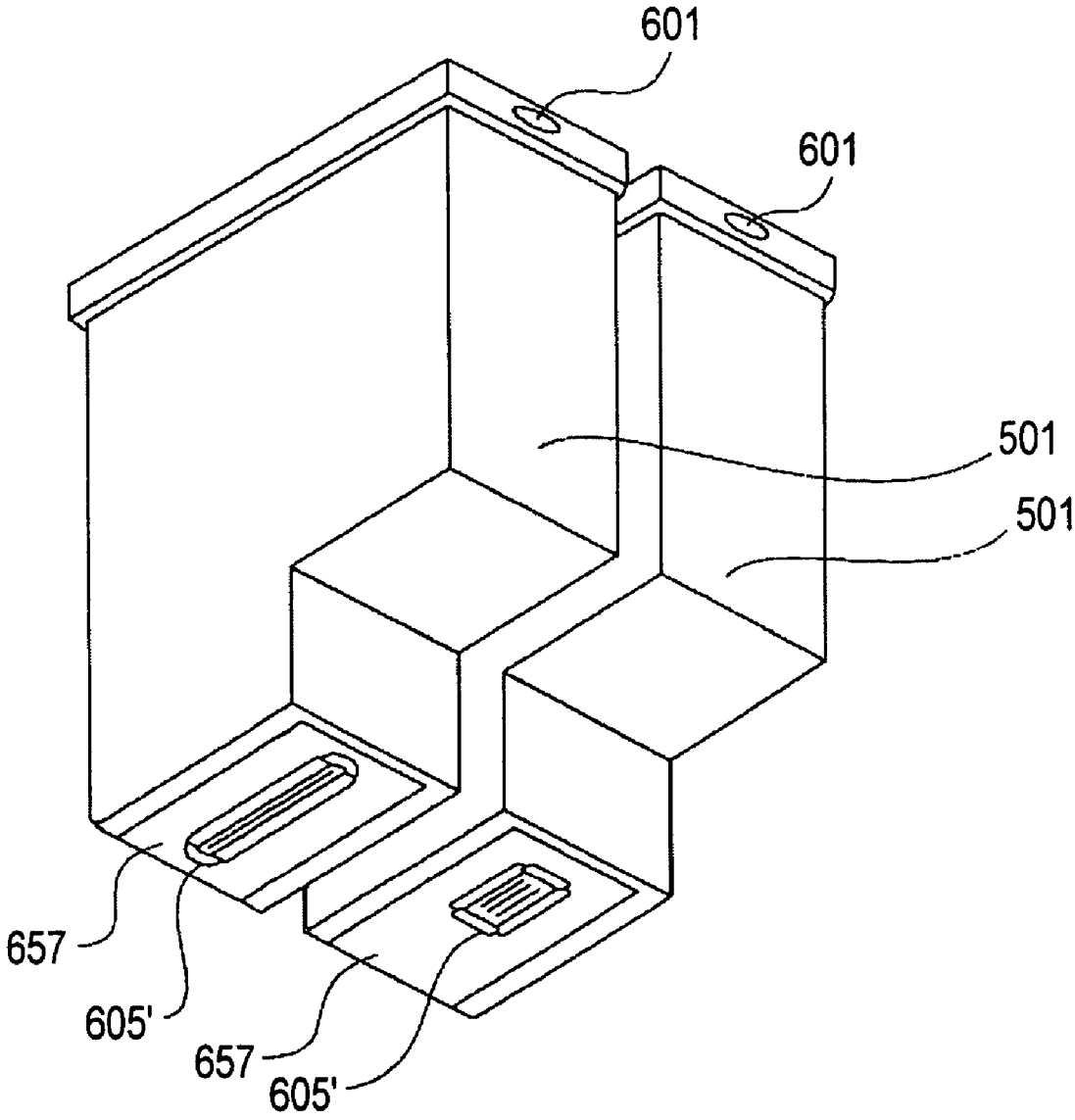
FIG. 25 is a perspective view showing a modified example of the structure of FIG. 24.
Figure 26:
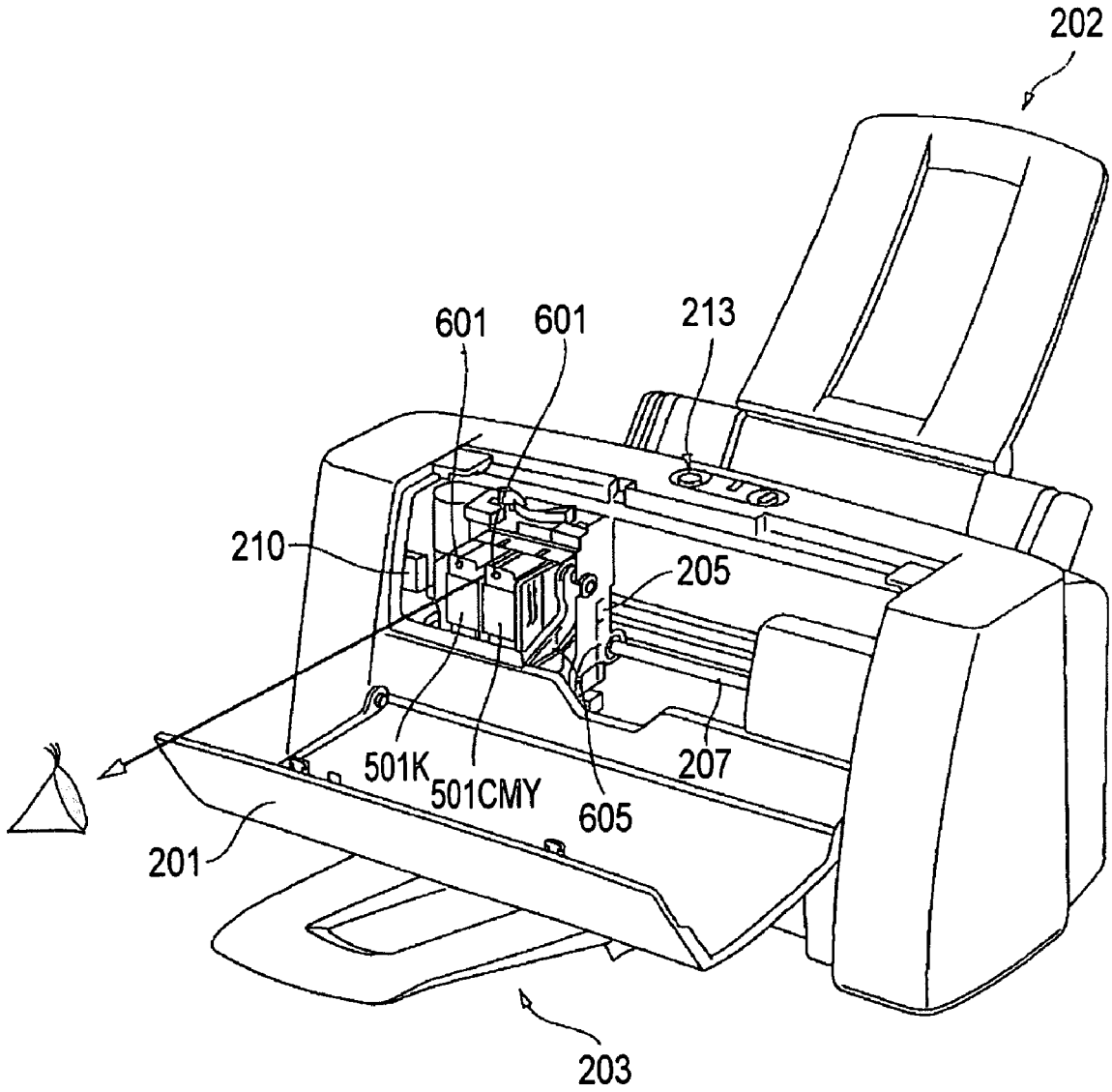
FIG. 26 is a perspective view showing a printer for effecting printing with the ink container having the structure according to said other embodiment.
Figure 27:
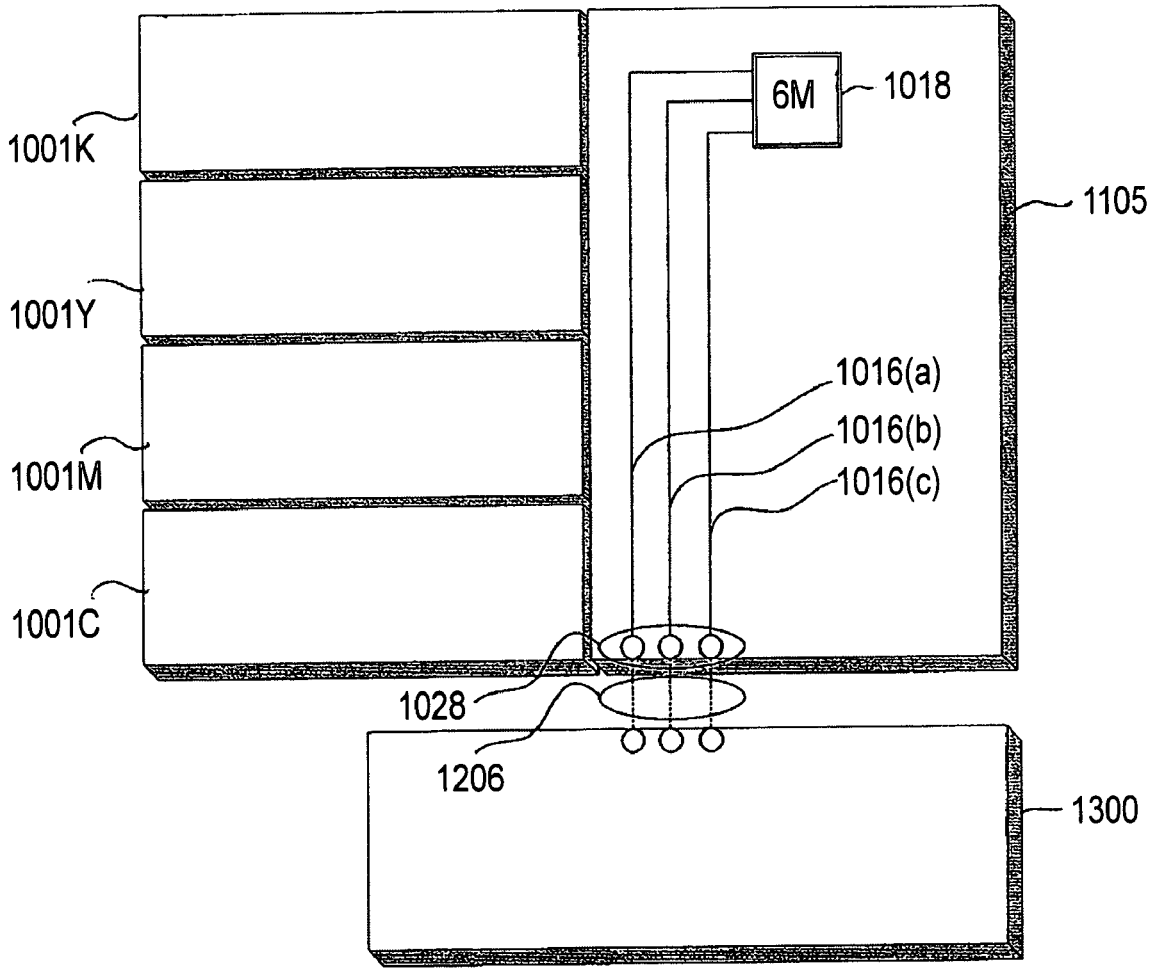
FIG. 27 is a schematic view illustrating an example of a conventional recording head, a conventional ink container and a conventional recording device.
Figure 28:
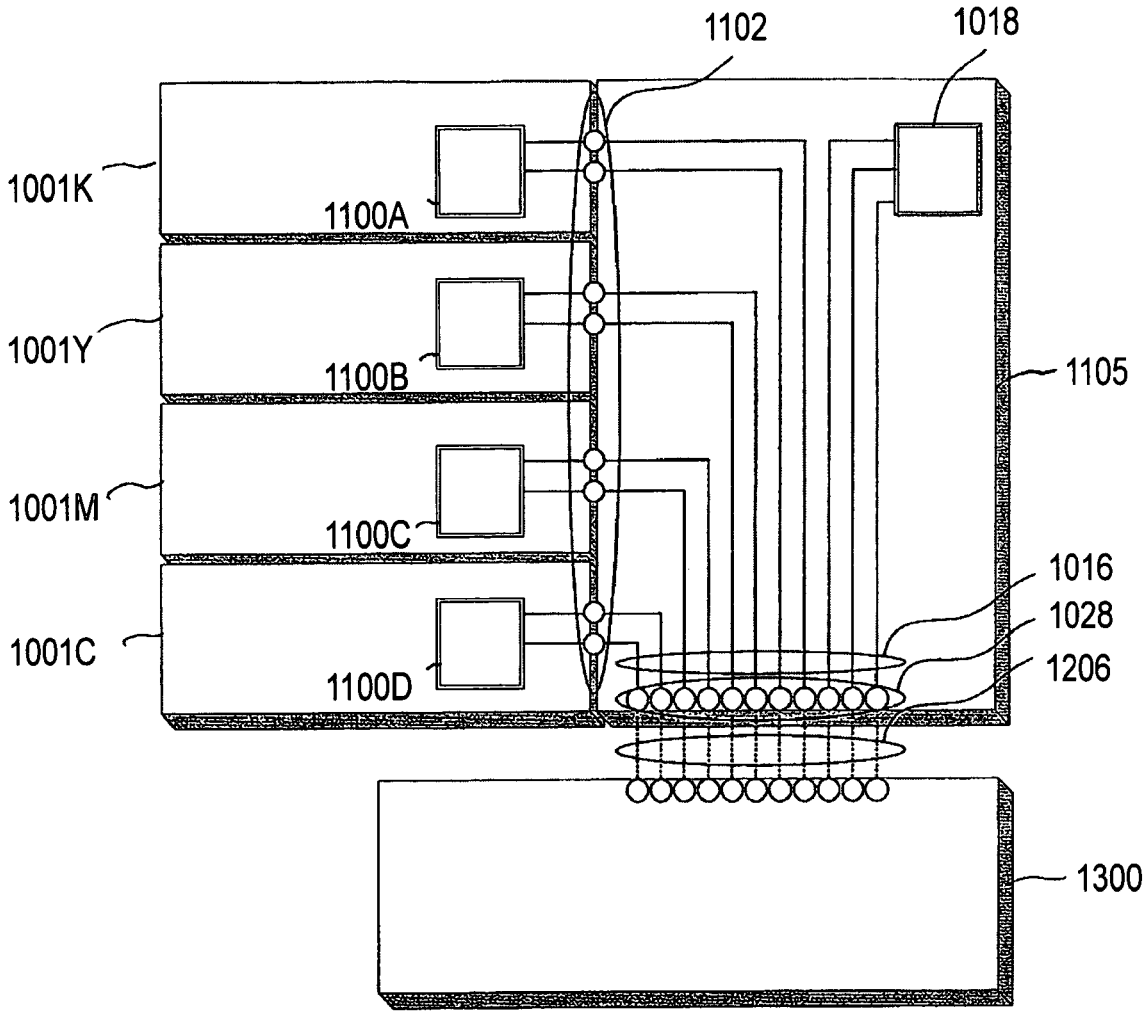
FIG. 28 is a schematic view of another example of a conventional recording head, a conventional ink container and a conventional recording device.
Figure 29:
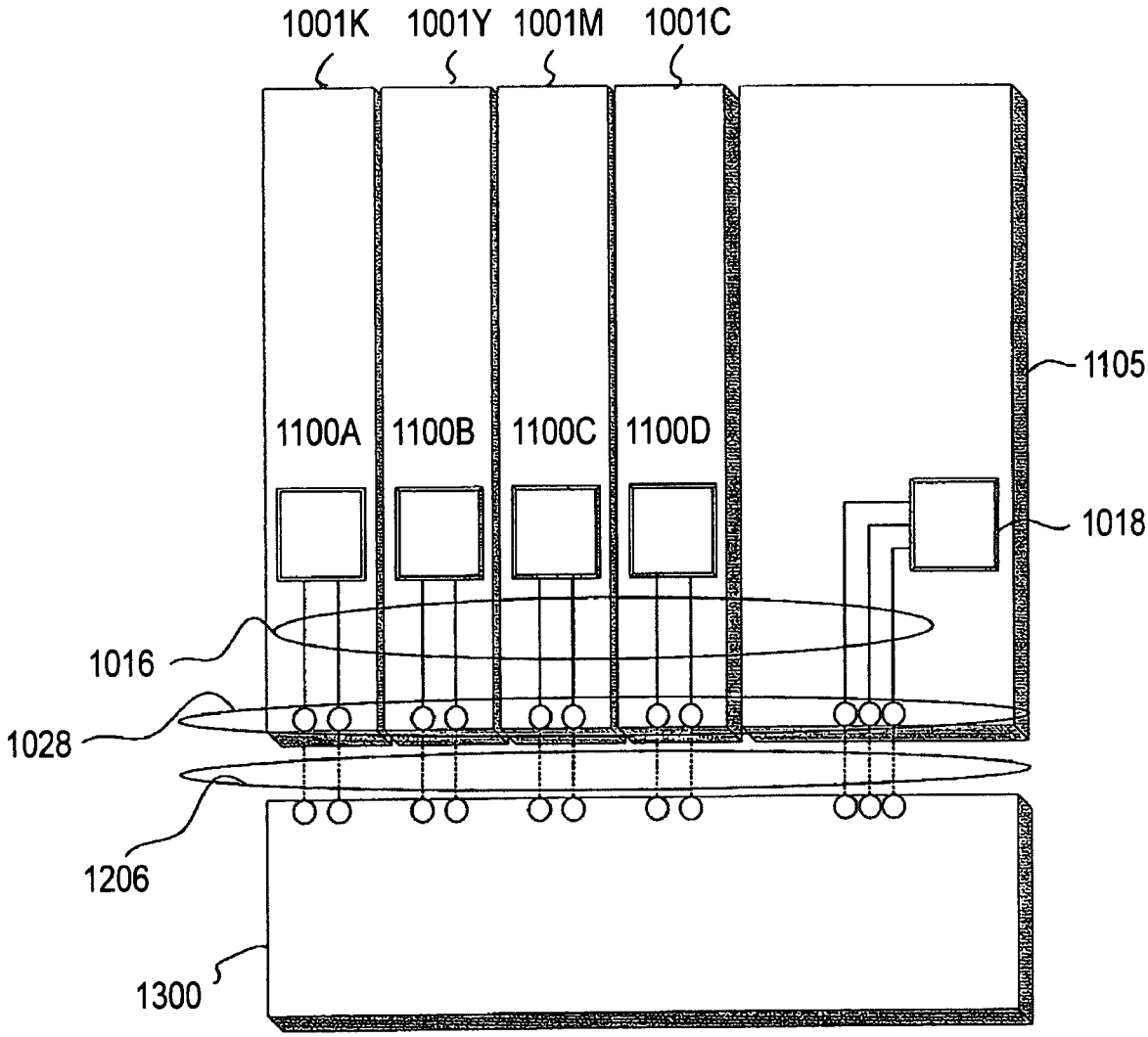
FIG. 29 is a schematic view of a further example of a conventional recording head, a conventional ink container and a conventional recording device.

3. Other Embodiments (FIG. 24–FIG. 26)

In the first embodiment described in the foregoing, the first engaging portion 5 provided on the ink container rear side is inserted into the first locking portion 155 provided at the rear side of the holder, and the ink container 1 is rotated about the rotational pivot which is the inserted portion, while pushing the ink container front side down. When such a structure is employed, the position of the substrate 100 is, as described hereinbefore, the front side which is away from the rotational pivot, and the first light receiving portion 210, and the first light emitting portion 101 for directing the light toward the first light receiving portion 210, toward the user's eyes are integral with the substrate 100, accordingly.

However, in some cases, the preferable position of the substrate and the position required by the light emitting portion are different from each other, depending on the structures of the ink container and/or the mounting portion thereof. In such a case, the substrate and the light emitting portion may be disposed at proper positions. In other words, they are not necessarily integral with each other.

Figure 24:
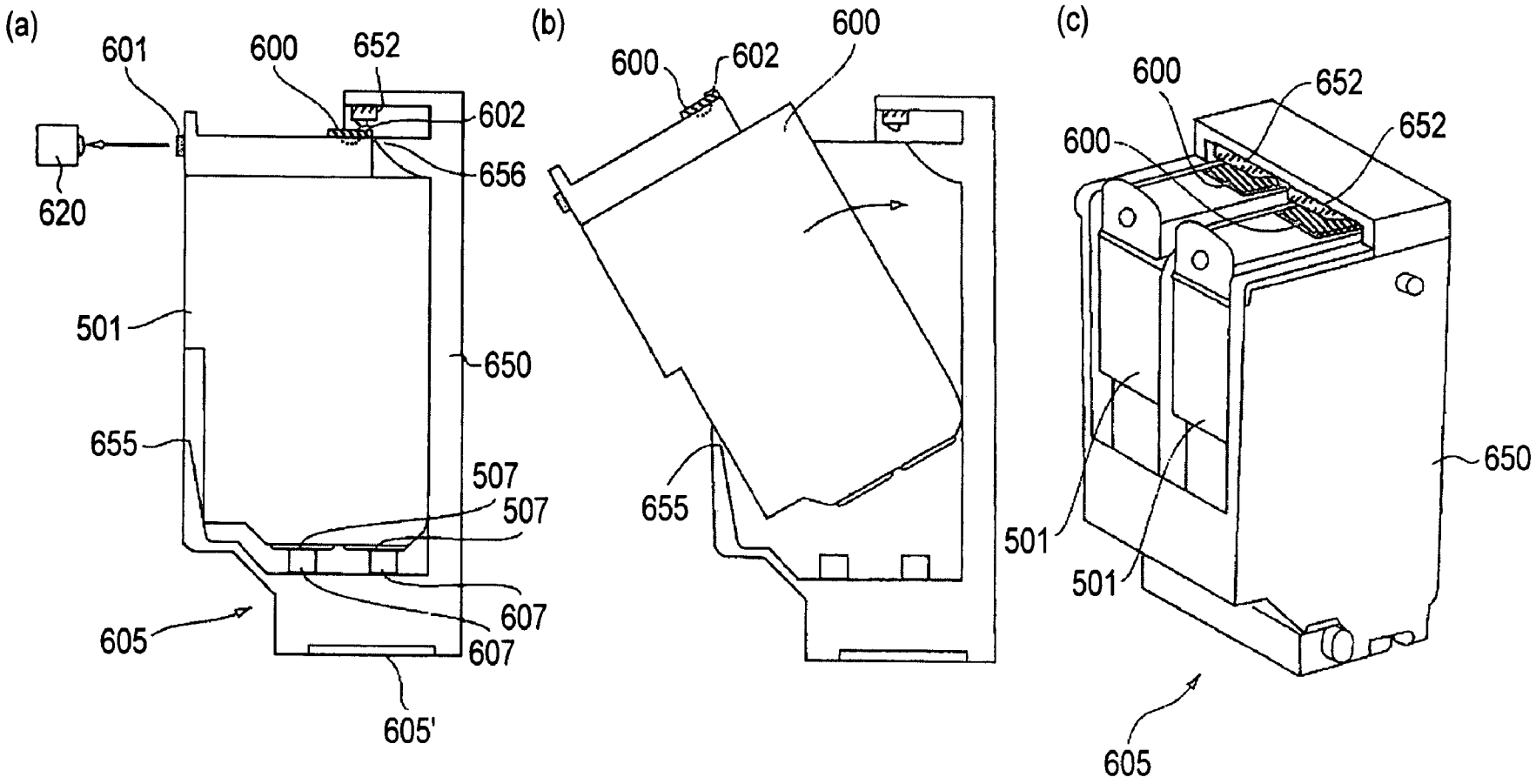
FIG. 24 illustrates structures of an ink container and a mounting portion thereof according to another embodiment of the present invention, and a mounting operation thereof (a)–(c).

FIG. 24 illustrates structures of an ink container and a mounting portion thereof according to another embodiment of the present invention ((a)–(c)).

As shown by (a) in FIG. 24, the ink container 501 of this embodiment of the present invention, is provided on the top side adjacent the front side with a substrate 600 which has a light emitting portion 601 such as LED, which has a pad 602 at the top rear portion. When the light emitting portion 601 is actuated, the light is emitted toward the front side. A light receiving portion 620 is disposed at a position for receiving the light directed leftward in the Figure adjacent an end of a scanning range of the carriage. When the carriage comes to such a position, the light emitting portion 601 is controlled, so that recording device side can obtain predetermined information relating to the ink container 501 from the content of the light received by the light receiving portion. When the carriage is at the center portion of the scanning range, for example, the light emitting portion 601 is controlled, by which the user is able to see the state of lightening so that predetermined information relating to the ink container 501 can be recognized by the user.

As shown by (c) in FIG. 24, the recording head unit 605 comprises a holder 650 for detachably holding a plurality of ink containers (two, in the example of the Figure), a recording head 605' provided at the bottom side thereof. By mounting the ink container 501 in the holder 650, an ink introduction opening 607 of the recording head side located in the inner bottom portion of the holder is connected with an ink supply port 507 located in the bottom portion of the ink container, so that ink fluid communication path is established therebetween. The holder 650 is provided on a rear side thereof with a locking portion 656 for locking the ink container 501 at the complete mounting position with the engaging portion 655 (rotational center) at the front side. Adjacent the locking portion 656, there is provided a connector 652 connected with a pad 502 of the substrate 500.

When the ink container 501 is mounted to the recording head unit 605, the user brings the ink container 501 to the front side of the holder 650, as shown by (b) in FIG. 24, presses the lower edge portion of the ink container rear side to the rear side of the holder 650 to bring the ink container front side into engagement with the engaging portion 655 of the holder 650. With this state, the upper portion of the front side of the ink container 501 is pressed toward the rear side, by which the ink container 501 is mounted in the holder while rotating in the direction indicated by an arrow about the engaging portion 655. Indicated by (a) and (c) in FIG. 24 is the ink container 501 which has been completely mounted, wherein the ink supply port 507 and the ink introduction opening 607 are connected to each other, and the pad 602 and the connector 652 are connected with each other. In addition, the pad 602 and the connector 652 are located at a position as far as possible from the rotational center upon the mounting operation, and immediately before completion of the mounting of the ink container 501, they are contacted to each other so that satisfy electrical connection property is established therebetween upon the completion of mounting.

The structures of the engaging portion 655 of the holder 650 and the locking portion 656 and the corresponding structure of the ink container 501 side, may be properly determined by one skilled in the art. In the example shown in the Figure, the substrate 600 is provided on the top surface of the ink container 501, and extends in parallel with the top surface, but this is not limiting, and it may be inclined as in the first embodiment. Furthermore, the holder 650 and the structural members relating to it is not necessarily provided in the head unit.

FIG. 25 shows a modified example of FIG. 24 structure, and shows two recording head units (liquid containing cartridges) each of which comprises an ink container 501 and a recording head 605' which are integral with each other. In this embodiment, one of the units is a cartridge for black ink, and the other is a cartridge for yellow, magenta and cyan inks.

The holder 650 may be provided with similar structures corresponding to such a structure. In this embodiment, the control circuit for the light emitting portion 601 disposed on the front side may be provided at a proper position on the head unit. For example, a control circuit is provided on the driving circuit substrate-having an integral recording head 605', and the wiring is extended to the light emitting portion 601. In such a case, a driving circuit for the recording head 605' and the control circuit for the light emitting portion 601 are connected with an electrical contact portion on the carriage through an unshown electrical contact portion.

FIG. 26 is a perspective view of a printer to which the ink container according to said another embodiment of the present invention. The same reference numerals as in Embodiment shown in FIG. 9 and FIG. 10 are assigned to the elements having the corresponding functions in this embodiment, and the detailed description thereof is omitted for simplicity.

As shown in FIG. 26, an ink container 501K containing black ink, and an ink containers 501CMY having integral accommodating chambers containing cyan, magenta and yellow inks separately, are mounted in the holder of the recording head unit 605 on the carriage 205. In each of the ink container, as described hereinbefore, the LED 601 is provided as a separate member from the substrate, and the user can see the LEDs 601 at the front side when the ink container is mounted at the exchange position. Corresponding to the position of the LEDs, a light receiving portion 210 is provided in the neighborhood of one of the end portions of the movement range of the carriage 205.

While the invention has been described with reference to the structures disclosed herein, it is not confined to the details set forth and this application is intended to cover such modifications or changes as may come within the purpose of the improvements or the scope of the following claims.

This application claims priority from Japanese Patent Applications Nos. 435942/2003 and 319751/2004 filed Dec. 26, 2003 and Nov. 2, 2004, which is hereby incorporated by reference.

What is claimed is:

1. A liquid container detachably mountable to a recording apparatus to which a plurality of liquid containers are detachably mountable, wherein said recording apparatus includes apparatus electrical contacts corresponding to the liquid containers, respectively, photoreceptor means for receiving light, and an electric circuit connected with a line which is commonly connected with said apparatus electrical contacts, said liquid container comprising:

a container electrical contact electrically connectable with one of said apparatus contacts;

an information storing portion capable of storing at least individual information relating to said liquid container;

a light emitting portion for emitting light toward said photoreceptor means;

an actuating portion for actuating said light emitting portion; and a controller for controlling access to said information storing portion and/or actuation of said light emitting portion by a driver in response to individual information supplied from the recording apparatus and reception of a command from the recording apparatus.

2. A liquid container according to claim 1, wherein the line which is commonly connected with said apparatus electrical contacts transmits the signal indicative of individual information.

3. A recording apparatus comprising a carriage for carrying said liquid container as defined in claim 1, and photoreceptor said means for receiving the light from said light emitting portion.

4. An apparatus according to claim 3, wherein said carriage is movable to a position where said photoreceptor means and said light emitting portion are opposed to each other.

5. A liquid container detachably mountable to a recording apparatus to which a plurality of liquid containers are detachably mountable at different positions, wherein said recording apparatus includes apparatus electrical contacts corresponding to the liquid containers, respectively, photoreceptor means for receiving light, and an electric circuit connected with a line which is commonly connected with said apparatus electrical contacts, said liquid container comprising:

a container electrical contact electrically connectable with one of said apparatus contacts;

an information storing portion storing at least individual information relating to said liquid container;

a light emitting portion for emitting light toward said photoreceptor means;

an actuating portion for actuating said light emitting portion; and a controller for controlling access to said information storing portion and/or actuation of said light emitting portion by a driver in response to individual information supplied from the recording apparatus and reception of a command from the recording apparatus.

6. A liquid container according to claim 5, wherein said controller controls access to said information storing portion and/or actuation of said light emitting portion when information indicated by a signal indicative of individual information supplied through said container electrical contact and said information stored in said information storing means, are the same.

7. A liquid container according to claim 6, wherein said controller obtains and/or renews the information in said information storing portion by receiving a command for access to said information storing portion supplied from the recording apparatus.

8. A liquid container according to claim 6, wherein said controller controls said actuating portion to switch said light emitting portion on by receiving a command for switching the light emitting portion on, supplied from the recording apparatus.

9. A liquid container according to claim 5, wherein said information storing portion, said light emitting portion and said controller are disposed on one substrate.

10. A liquid container according to claim 5, wherein said liquid container contains ink.

11. A liquid supplying system comprising: a recording apparatus to which a plurality of liquid containers are detachably mountable at different positions, said recording apparatus including, apparatus electrical contacts corresponding to the liquid containers, respectively, photoreceptor means for receiving light, and an electric circuit connected with a line which is commonly connected with said apparatus electrical contacts, and a liquid container detachably mountable to a carriage of said recording apparatus, wherein said liquid container includes:

a container electrical contact electrically connectable with one of said apparatus contacts;

an information storing portion storing at least individual information relating to said liquid container;

a light emitting portion for emitting light toward said photoreceptor means;

an actuating portion for actuating said light emitting portion; and a controller for controlling access to said information storing portion and/or actuation of said light emitting portion by a driver in response to individual information supplied from the recording apparatus device and reception of a command from the recording apparatus.

12. A liquid supplying system according to claim 11, wherein the line which is commonly connected with said apparatus electrical contacts transmits a signal indicative of individual information.

13. A manufacturing method for manufacturing a liquid container detachably mountable to a recording apparatus to which a plurality of liquid containers are detachably mountable at different positions, wherein said recording apparatus includes apparatus electrical contacts corresponding to the liquid containers, respectively, photoreceptor means for receiving light, and an electric circuit connected with a line which is commonly connected with said apparatus electrical contacts, said method comprising the steps of:

preparing a liquid container including a substrate, said substrate having a container electrical contact electrically connectable with one of said apparatus contacts; an information storing portion capable of storing at least individual information relating to said liquid container; a light emitting portion for emitting light toward said photoreceptor means; an actuating portion for actuating said light emitting portion; and a controller for controlling access to said information storing portion and/or actuation of said light emitting portion by a driver in response to individual information supplied from the recording apparatus and reception of a command from the recording apparatus; and injecting ink into said liquid container.

14. A manufacturing method according to claim 13, wherein the line which is commonly connected with said apparatus electrical contacts transmits a signal indicative of individual information.

15. A circuit board for a liquid container which is detachably mountable to a recording apparatus to which a plurality of liquid containers are detachably mountable at different positions, wherein said recording apparatus includes apparatus electrical contacts corresponding to the liquid containers, respectively, photoreceptor means for receiving light, and an electric circuit connected with a line which is commonly connected with said apparatus electrical contacts, said circuit board comprising:

a container electrical contact electrically connectable with one of said apparatus electrical contacts;

an information storing portion storing at least individual information relating to said liquid container;

a connecting portion for connection to a light emitting portion for emitting light toward said photoreceptor means;

an actuating portion for actuating said light emitting portion; and a controller for controlling access to said information storing portion and/or actuation of said light emitting portion by a driver in response to individual information supplied from the recording apparatus and reception of a command from the recording apparatus.

16. A circuit board according to claim 15, wherein the line which is commonly connected with said apparatus electrical contacts transmits a signal indicative of individual information.

17. A circuit board according to claim 15, wherein said light emitting portion is provided on said circuit board.

18. A liquid container detachably mountable to a recording apparatus to which a plurality of liquid containers are detachably mountable at different positions, wherein said recording apparatus includes apparatus electrical contacts corresponding to the liquid containers, respectively, photoreceptor means for receiving light, and an electric circuit connected with a line which is commonly connected with said apparatus electrical contacts, said liquid container comprising:

a recording head for effecting recording by ejecting liquid;

a container electrical contact electrically connectable with one of said apparatus electrical contacts;

an information storing portion storing at least individual information relating to said liquid containers;

a light emitting portion for emitting light toward said photoreceptor means;

an actuating portion for actuating said light emitting portion; and a controller for controlling access to said information storing portion and/or actuation of said light emitting portion by a driver in response to individual information supplied from the recording apparatus and reception of a command from the recording apparatus.

19. A liquid container according to claim 18, wherein the line which is commonly connected with said apparatus electrical contacts transmits a signal indicative of individual information.

20. A liquid container detachably mountable to a recording apparatus to which a plurality of liquid containers are detachably mountable at different positions, wherein said recording apparatus includes apparatus electrical contacts corresponding to the liquid containers, respectively, photoreceptor means for receiving light, and an electric circuit connected with a line which is commonly connected with said apparatus electrical contacts, said liquid container comprising:

ink contained in said liquid container;

a container electrical contact electrically connectable with one of said apparatus electrical contacts;

an information storing portion capable of storing at least individual information of the ink contained in said liquid container;

a light emitting portion for emitting light toward said photoreceptor means;

an actuating portion for actuating said light emitting portion;

a controller for controlling access to said information storing portion in accordance with reception of information and a command relating to the ink supplied from the recording apparatus and/or actuation of said light emitting portion by said actuating portion.

21. A liquid container according to claim 20, wherein the line which is commonly connected with said apparatus electrical contacts transmits a signal indicative of individual information.

22. A liquid container detachably mountable to a recording apparatus to which a plurality of liquid containers are detachably mountable at different positions, wherein said recording apparatus includes apparatus electrical contacts corresponding to the liquid containers, respectively, photoreceptor means for receiving light, and an electric circuit connected with a line which is commonly connected with said apparatus electrical contacts, said liquid container comprising:

ink container body provided with a substrate, ink contained in said container body, said substrate includes, a container electrical contact electrically connectable with one of said apparatus electrical contacts, an information storing portion capable of storing at least individual information of the ink contained in said liquid container, a light emitting portion for emitting light to said position detecting means;

an actuating portion for actuating said light emitting portion, and a controller for controlling access to said information storing portion in accordance with reception of information and a command relating to the ink supplied from the recording apparatus and/or actuation of said light emitting portion by said actuating portion.

23. A liquid container detachably mountable to a recording apparatus to which a plurality of liquid containers are detachably mountable at different positions, wherein said recording apparatus includes apparatus electrical contacts corresponding to the liquid containers, respectively, photoreceptor means for receiving light, and an electric circuit connected with a line which is commonly connected with said apparatus electrical contacts, said liquid container comprising:

ink container body provided with a mounting portion for mounting a substrate, wherein said substrate includes a container electrical contact electrically connectable with one of said apparatus electrical contacts, an information storing portion capable of storing at least individual information of the ink contained in said liquid container, a light emitting portion for emitting light toward said photoreceptor means; an actuating portion for actuating said light emitting portion; and a controller for controlling access to said information storing portion in accordance with reception of information and a command relating to the ink supplied from the recording apparatus and/or actuation of said light emitting portion by said actuating portion.

24. A liquid container according to claim 22 or 23, further comprising a line which is commonly connected with said apparatus electrical contacts transmits the signal indicative of individual information.

* * * * *

UNITED STATES PATENT AND TRADEMARK OFFICE

CERTIFICATE OF CORRECTION

PATENT NO. : 7,237,881 B2
APPLICATION NO. : 11/016757
DATED : July 3, 2007
INVENTOR(S) : Kimiyuki Hayasaki et al.

It is certified that error appears in the above-identified patent and that said Letters Patent is hereby corrected as shown below:

COLUMN 1
Line 48, “onto” should read --on--.

COLUMN 2
Line 25, “Central” should read --(Central--.

COLUMN 3
Line 5, “form” should read --from--; and
Line 30, “1100A-1000D” should read --1100A-1100D--.

COLUMN 4
Line 2, “t” should read --the--; and
Line 31, “1100A-s1000D” should read --1100A-1100D--.

COLUMN 5
Line 11, “t” should read --the--.

COLUMN 7
Line 10, “lightening” should read --lighting--;
Line 44, “1.3” should read --1.2--;
Line 45, “1.4” should read --1.3--; and
Line 53, “2.3” should read --2.5--.

COLUMN 8
Line 31, “FIG. 2 FIG. 2” should read --FIG. 2--;
Line 40, “fluid-communication” should read --fluid communication--; and
Line 67, “t” should read --the--.

COLUMN 9
Line 14, “in tended” should read --intended--; and
Line 19, “of the” should be deleted.

COLUMN 11
Line 3, “and.” should read --and--; and
Line 4, “Sufficiency” should read --sufficiency--.

COLUMN 12
Line 24, “by. The” should read --by the--.

UNITED STATES PATENT AND TRADEMARK OFFICE

CERTIFICATE OF CORRECTION

PATENT NO. : 7,237,881 B2
APPLICATION NO. : 11/016757
DATED : July 3, 2007
INVENTOR(S) : Kimiyuki Hayasaki et al.

It is certified that error appears in the above-identified patent and that said Letters Patent is hereby corrected as shown below:

COLUMN 14
Line 39, “1.4” should read --1.3--; and
Line 64, “is” should be deleted.

COLUMN 15
Line 25, “t” should read --the--;
Line 26, “t” should read --the--; and
Line 30, “scan” should read --scans--.

COLUMN 16
Line 8, “form” should read --from--; and
Line 12, “FIG. 11.” should be deleted.

COLUMN 17
Line 19, “FIG. 20 FIG. 20” should be deleted.

COLUMN 18
Line 1, “form” should read --from--; and
Line 32, “data” should read --data.--.

COLUMN 19
Line 7, “Operation” should read --2.4 Operation--.
Line 19, “begining” should read --beginning--; and
Line 48, “for for” should read --for--.

COLUMN 20
Line 2, “that. The” should read --that the--.

COLUMN 22
Line 42, “returns” should read --returns to--.

COLUMN 24
Line 12, “FIG 23q” should be deleted.

UNITED STATES PATENT AND TRADEMARK OFFICE

CERTIFICATE OF CORRECTION

PATENT NO. : 7,237,881 B2
APPLICATION NO. : 11/016757
DATED : July 3, 2007
INVENTOR(S) : Kimiyuki Hayasaki et al.

It is certified that error appears in the above-identified patent and that said Letters Patent is hereby corrected as shown below:

COLUMN 27

Line 12, "said means" should read --means--.

Signed and Sealed this

First Day of April, 2008

JON W. DUDAS
*Director of the United States Patent and Trademark Office*